US012523041B2

(12) United States Patent
Lenney

(10) Patent No.: US 12,523,041 B2
(45) Date of Patent: Jan. 13, 2026

(54) GUTTER GUARD WITH GIRDER

(71) Applicant: Gutterglove, Inc., Franklin, TN (US)

(72) Inventor: Robert Lenney, Lincoln, CA (US)

(73) Assignee: GUTTERGLOVE, INC., Franklin, TN (US)

( * ) Notice: Subject to any disclaimer, the term of this patent is extended or adjusted under 35 U.S.C. 154(b) by 0 days.

(21) Appl. No.: 18/635,912

(22) Filed: Apr. 15, 2024

(65) Prior Publication Data

US 2024/0344327 A1 Oct. 17, 2024

Related U.S. Application Data

(63) Continuation of application No. 18/063,043, filed on Dec. 7, 2022, now Pat. No. 11,982,088, which is a continuation of application No. 16/864,131, filed on Apr. 30, 2020, now Pat. No. 11,566,428, which is a continuation of application No. 16/862,537, filed on Apr. 29, 2020, now Pat. No. 11,384,544.

(60) Provisional application No. 62/841,403, filed on May 1, 2019, provisional application No. 62/841,394, filed on May 1, 2019, provisional application No. 62/841,387, filed on May 1, 2019.

(51) Int. Cl.

| | |
|---|---|
| ***E04D 13/076*** | (2006.01) |
| ***E04D 13/064*** | (2006.01) |
| ***E04D 13/068*** | (2006.01) |

(52) U.S. Cl.

CPC ..... *E04D 13/076* (2013.01); *E04D 13/064* (2013.01); *E04D 13/068* (2013.01)

(58) Field of Classification Search

CPC .... E04D 13/076; E04D 13/068; E04D 13/064

See application file for complete search history.

(56) References Cited

U.S. PATENT DOCUMENTS

| | | | |
|---|---|---|---|
| 447,084 | A | 2/1891 | Sagendorph |
| 521,499 | A | 6/1894 | Hayes |
| 1,077,404 | A | 11/1913 | Goldsmith |
| 1,732,058 | A | 10/1929 | Martini |
| 1,840,537 | A | 1/1932 | Siebenlist |

(Continued)

FOREIGN PATENT DOCUMENTS

| | | |
|---|---|---|
| AU | 2013201320 | 3/2013 |
| CA | 1310167 | 11/1992 |

(Continued)

OTHER PUBLICATIONS

Valor Gutter Guard's Melt Away Use Guide, published Apr. 2014.

*Primary Examiner* — Jessie T Fonseca

(74) *Attorney, Agent, or Firm* — Jonathan Kidney; Glen Gross; Intelink Law Group, PC

(57) ABSTRACT

A gutter guard device is described, comprising, a bridge member composed of a sheet or micro-mesh decking material having a plurality of orifices, and having a roof side and an opposing gutter lip side; at least one girder spanning a bottom surface of the bridge member from a proximal end of the bridge member's roof side to a proximal end of the bridge member's gutter lip side; a roof attachment member attached to an end section of the roof side of the bridge member and configured to attach to a roof; and a gutter attachment member attached to an end section of the gutter lip side of the bridge member and configured to attach to a gutter lip, wherein the device is self-supporting.

11 Claims, 31 Drawing Sheets

(56) References Cited

U.S. PATENT DOCUMENTS

| | | | |
|---|---|---|---|
| 1,859,409 | A | 5/1932 | Purser |
| 2,229,381 | A | 1/1941 | Grow |
| 2,288,121 | A | 6/1942 | Sandmeyer |
| 2,569,568 | A | 10/1951 | Lipshaw |
| 2,583,422 | A | 1/1952 | Haddon |
| 2,674,961 | A | 4/1954 | Lake |
| 2,935,954 | A | 5/1960 | Matthews |
| 2,997,763 | A | 8/1961 | Serfass |
| 3,350,045 | A | 10/1967 | Mayers |
| 3,630,383 | A | 12/1971 | Reeves |
| 3,691,343 | A | 9/1972 | Norman |
| 3,925,264 | A | 12/1975 | Corte |
| 4,254,595 | A | 3/1981 | Crossien |
| 4,308,696 | A | 1/1982 | Schroeder |
| 4,435,466 | A | 3/1984 | Kuhnel et al. |
| 4,573,290 | A | 3/1986 | Fleming |
| 4,604,837 | A | 8/1986 | Beam |
| 4,646,488 | A | 3/1987 | Burns |
| 4,745,710 | A | 5/1988 | Davis |
| 4,750,300 | A | 6/1988 | Winger |
| 4,755,229 | A | 7/1988 | Armanini |
| 4,769,526 | A | 9/1988 | Taouil |
| 4,827,686 | A | 5/1989 | Stamper |
| 4,941,299 | A | 7/1990 | Sweers |
| 4,949,514 | A | 8/1990 | Weller |
| 4,954,015 | A | 9/1990 | McGowan |
| 4,959,932 | A | 10/1990 | Pfeifer |
| 5,010,696 | A | 4/1991 | Knittel |
| 5,035,092 | A | 7/1991 | Brant |
| 5,038,528 | A | 8/1991 | Brant |
| 5,044,581 | A | 9/1991 | Dressler |
| 5,067,675 | A | 11/1991 | Brant |
| 5,092,086 | A | 3/1992 | Rognsvoog, Sr. |
| 5,098,045 | A | 3/1992 | Pepper |
| 5,107,635 | A | 4/1992 | Carpenter |
| 5,109,640 | A | 5/1992 | Creson |
| 5,127,200 | A | 7/1992 | Doran |
| 5,181,350 | A | 1/1993 | Meckstroth |
| 5,216,852 | A | 6/1993 | Bemis et al. |
| 5,228,247 | A | 7/1993 | Dressler |
| 5,257,482 | A | 11/1993 | Sichel |
| 5,261,195 | A | 11/1993 | Buckenmaier |
| 5,315,090 | A | 5/1994 | Lowenthal |
| 5,371,979 | A | 12/1994 | Kwiatkowski et al. |
| 5,375,379 | A | 12/1994 | Meckstroth |
| 5,391,858 | A | 2/1995 | Tourangeau et al. |
| 5,398,464 | A | 3/1995 | Jacobs |
| 5,406,754 | A | 4/1995 | Cosby |
| 5,406,756 | A | 4/1995 | Bemis et al. |
| 5,438,803 | A | 8/1995 | Blizard, Jr. |
| 5,459,965 | A | 10/1995 | Meckstroth |
| D364,338 | S | 11/1995 | Cline |
| 5,522,185 | A | 6/1996 | Cline |
| D372,421 | S | 8/1996 | Cline |
| 5,558,705 | A | 9/1996 | Keemer et al. |
| 5,570,557 | A | 11/1996 | Kwiatkowski et al. |
| 5,617,678 | A | 4/1997 | Morandin |
| 5,640,809 | A | 6/1997 | Iannelli |
| 5,729,931 | A | 3/1998 | Wade |
| 5,759,255 | A | 6/1998 | Venturini et al. |
| 5,836,117 | A | 11/1998 | Johnson |
| 5,842,311 | A | 12/1998 | Morin |
| 5,842,469 | A | 12/1998 | Rapp et al. |
| 5,848,857 | A | 12/1998 | Killworth et al. |
| 5,878,533 | A | 3/1999 | Swanfeld |
| 5,893,240 | A | 4/1999 | Ealer, Sr. |
| D418,403 | S | 1/2000 | Cline |
| D419,863 | S | 2/2000 | Mullane |
| 6,035,587 | A | 3/2000 | Dressler |
| 6,134,843 | A | 10/2000 | Tregear |
| 6,194,049 | B1 | 2/2001 | Bindschedler-Galli et al. |
| 6,194,519 | B1 | 2/2001 | Blalock et al. |
| 6,205,715 | B1 | 3/2001 | Rex |
| 6,223,777 | B1 | 5/2001 | Smith et al. |
| 6,225,600 | B1 | 5/2001 | Burris |
| 6,266,929 | B1 | 7/2001 | Cline |
| 6,341,462 | B2 | 1/2002 | Kiik et al. |
| D457,423 | S | 5/2002 | Mullane |
| 6,412,228 | B1 | 7/2002 | Meckstroth |
| 6,468,613 | B1 | 10/2002 | Kitano |
| 6,543,729 | B1 | 4/2003 | Ylonen |
| D475,613 | S | 6/2003 | Mullane |
| 6,598,352 | B2 | 7/2003 | Higginbotham |
| 6,607,781 | B2 | 8/2003 | Joedicke et al. |
| D481,929 | S | 11/2003 | McNichol |
| 6,700,098 | B1 | 3/2004 | Wyatt et al. |
| 6,708,452 | B1 | 3/2004 | Tenute |
| 6,759,630 | B1 | 7/2004 | Tenute |
| D494,461 | S | 8/2004 | Dressler |
| D495,595 | S | 9/2004 | Dressler |
| D499,331 | S | 12/2004 | Dressler |
| 6,933,007 | B2 | 8/2005 | Fensel et al. |
| 6,942,419 | B2 | 9/2005 | Knak et al. |
| 6,944,991 | B2 | 9/2005 | Kim |
| 6,944,992 | B2 | 9/2005 | Brochu |
| 6,951,077 | B1 | 10/2005 | Higginbotham |
| 6,951,323 | B1 | 10/2005 | McNichol |
| D511,451 | S | 11/2005 | Mullane |
| 6,959,512 | B2 | 11/2005 | Cobb |
| D514,670 | S | 2/2006 | Handley |
| 7,017,614 | B2 | 3/2006 | Handley |
| D519,025 | S | 4/2006 | Dressler |
| 7,056,422 | B2 | 6/2006 | Swistun |
| 7,104,012 | B1 | 9/2006 | Bayram |
| 7,127,852 | B1 | 10/2006 | Dressler |
| 7,174,677 | B1 | 2/2007 | Dressler |
| 7,174,688 | B2 | 2/2007 | Higginbotham |
| 7,191,564 | B2 | 3/2007 | Higginbotham |
| 7,241,500 | B2 | 7/2007 | Shiao et al. |
| 7,310,912 | B2 | 12/2007 | Lenney |
| 7,340,863 | B1 | 3/2008 | Dressler |
| 7,434,358 | B2 | 10/2008 | Smith |
| 7,448,167 | B2 | 11/2008 | Bachman |
| 7,493,686 | B2 | 2/2009 | Barford |
| 7,516,576 | B1 | 4/2009 | Mullane |
| 7,597,119 | B2 | 10/2009 | Boettner |
| 7,624,541 | B2 | 12/2009 | Gentry |
| 7,677,271 | B2 | 3/2010 | Boettner |
| 7,726,076 | B2 | 6/2010 | Staub |
| 7,793,465 | B2 | 9/2010 | McCann |
| 7,913,458 | B2 | 3/2011 | Higginbotham |
| D638,920 | S | 5/2011 | Ealer, Sr. |
| 7,975,435 | B2 | 7/2011 | Lenney |
| 8,033,058 | B2 | 10/2011 | Block |
| 8,079,183 | B2 | 12/2011 | Lenney |
| 8,251,302 | B2 | 8/2012 | Sloan, Jr. |
| 8,276,321 | B2 | 10/2012 | Bell |
| 8,312,677 | B2 | 11/2012 | Higginbotham |
| 8,418,410 | B2 | 4/2013 | Martin |
| 8,438,788 | B2 | 5/2013 | Bell et al. |
| 8,479,454 | B2 | 7/2013 | Lenney |
| 8,495,837 | B2 | 7/2013 | McCoy |
| 8,572,899 | B1 | 11/2013 | Pearce et al. |
| 8,607,827 | B2 | 12/2013 | Bell |
| 8,677,694 | B2 | 3/2014 | Ash |
| 8,689,837 | B1 | 4/2014 | Smith |
| 8,720,132 | B2 | 5/2014 | Chihlas |
| D709,357 | S | 7/2014 | Bell |
| 8,782,960 | B2 | 7/2014 | Nark |
| 8,901,458 | B2 | 12/2014 | Aussi |
| 9,080,328 | B1 | 7/2015 | Smith |
| D752,722 | S | 3/2016 | Boettner |
| 9,309,995 | B2 | 4/2016 | Bell |
| 9,487,955 | B2 | 11/2016 | Breyer |
| D790,672 | S | 6/2017 | Benjamin |
| 9,890,535 | B2 | 2/2018 | Breyer |
| 9,915,070 | B2 | 3/2018 | Lenney |
| 9,976,309 | B2 | 5/2018 | Lenney |
| 9,982,438 | B2 | 5/2018 | Casey |
| 10,081,937 | B2 | 9/2018 | Elliott |
| D837,048 | S | 1/2019 | Benjamin et al. |
| 10,233,647 | B2 | 3/2019 | Benjamin et al. |
| 10,233,648 | B2 | 3/2019 | Lenney |
| D878,189 | S | 3/2020 | Benjamin et al. |

(56) References Cited

U.S. PATENT DOCUMENTS

| | | | |
|---|---|---|---|
| 10,781,592 | B2 | 9/2020 | Lenney |
| 11,193,280 | B2 | 12/2021 | Lenney |
| 2001/0054625 | A1 | 12/2001 | Iggulden |
| 2003/0046876 | A1 | 3/2003 | Higginbotham |
| 2003/0187539 | A1 | 10/2003 | Smith |
| 2003/0198736 | A1 | 10/2003 | Fensel et al. |
| 2005/0072114 | A1 | 4/2005 | Shiao et al. |
| 2005/0196124 | A1 | 9/2005 | Aldereguia et al. |
| 2005/0235577 | A1 | 10/2005 | Smith |
| 2005/0257432 | A1 | 11/2005 | Higginbotham |
| 2005/0279036 | A1 | 12/2005 | Brochu |
| 2006/0037252 | A1 | 2/2006 | Gosse et al. |
| 2006/0090404 | A1 | 5/2006 | Lovell |
| 2006/0117670 | A1 | 6/2006 | Tsioris |
| 2006/0179723 | A1 | 8/2006 | Robins |
| 2006/0196124 | A1 | 9/2006 | Bachman |
| 2006/0213129 | A1 | 9/2006 | Bachman |
| 2006/0230687 | A1 | 10/2006 | Ealer, Sr. |
| 2006/0277831 | A1 | 12/2006 | Bachman |
| 2006/0283096 | A1 | 12/2006 | Bachman |
| 2006/0288652 | A1 | 12/2006 | Gurr |
| 2007/0054129 | A1 | 3/2007 | Kalkanoglu et al. |
| 2007/0065640 | A1 | 3/2007 | Joedicke |
| 2007/0094939 | A1 | 5/2007 | Bachman |
| 2007/0107323 | A1 | 5/2007 | Higginbotham |
| 2007/0193012 | A1 | 8/2007 | Bergman et al. |
| 2007/0199276 | A1 | 8/2007 | Duque |
| 2007/0214731 | A1* | 9/2007 | Bachman ..... E04D 13/076 52/12 |
| 2007/0218251 | A1 | 9/2007 | Jacobs |
| 2007/0220814 | A1 | 9/2007 | Faulks |
| 2007/0234647 | A1 | 10/2007 | Higginbotham |
| 2007/0246449 | A1 | 10/2007 | Bachman |
| 2008/0000169 | A1 | 1/2008 | Handley |
| 2008/0187708 | A1 | 8/2008 | Decker |
| 2008/0248241 | A1 | 10/2008 | Kalkanoglu et al. |
| 2009/0056234 | A1 | 3/2009 | Brochu |
| 2009/0064628 | A1 | 3/2009 | Mellott et al. |
| 2009/0139180 | A1 | 6/2009 | Kehs et al. |
| 2009/0300995 | A1 | 12/2009 | Nikolopoulos |
| 2010/0042579 | A1 | 2/2010 | Larsen et al. |
| 2011/0047930 | A1 | 3/2011 | Nark |
| 2011/0049118 | A1 | 3/2011 | Nark |
| 2011/0056145 | A1 | 3/2011 | Lenney |
| 2011/0067318 | A1 | 3/2011 | Lenney et al. |
| 2011/0138698 | A1 | 6/2011 | Neumann |
| 2011/0253611 | A1 | 10/2011 | Higginbotham |
| 2012/0042579 | A1 | 2/2012 | McCoy |
| 2012/0049511 | A1 | 3/2012 | Bell et al. |
| 2012/0068452 | A1 | 3/2012 | Boettner |
| 2012/0144759 | A1 | 6/2012 | Higginbotham |
| 2013/0097943 | A1 | 4/2013 | Higginbotham |
| 2013/0160377 | A1 | 6/2013 | Sager |
| 2013/0160378 | A1 | 6/2013 | Higginbotham |
| 2013/0284650 | A1 | 10/2013 | Higginbotham |
| 2013/0319990 | A1 | 12/2013 | Casey |
| 2014/0013702 | A1 | 1/2014 | Pearce et al. |
| 2014/0069028 | A1 | 3/2014 | Lenney |
| 2014/0090311 | A1 | 4/2014 | Iannelli |
| 2014/0130929 | A1 | 5/2014 | Elliott et al. |
| 2014/0196400 | A1 | 7/2014 | Bell |
| 2014/0263001 | A1 | 9/2014 | Higginbotham |
| 2014/0291310 | A1 | 10/2014 | Iannelli |
| 2014/0326837 | A1 | 11/2014 | Rumsey |
| 2015/0143756 | A1 | 5/2015 | Higginbotham |
| 2015/0184394 | A1 | 7/2015 | Nark |
| 2015/0225959 | A1* | 8/2015 | Lenney ..... E04D 13/076 52/12 |
| 2016/0102459 | A1 | 4/2016 | Breyer |
| 2016/0168858 | A1 | 6/2016 | Breyer |
| 2017/0089071 | A1 | 3/2017 | Smith et al. |
| 2018/0179761 | A1 | 6/2018 | Higginbotham |
| 2018/0216755 | A1 | 8/2018 | Rumsey |

FOREIGN PATENT DOCUMENTS

| | | |
|---|---|---|
| CA | 2021168 | 2/2002 |
| CA | 2021169 | 2/2002 |
| CA | 2476351 | 11/2005 |
| CA | 2551297 | 12/2007 |
| CA | 2390777 | 5/2008 |
| CA | 2752598 | 3/2013 |
| CA | 2938647 | 1/2019 |
| CN | 102781546 A | 11/2012 |
| CN | 106068154 A | 11/2016 |
| EP | 1344640 | 4/2006 |
| EP | 2518226 | 10/2012 |
| FR | 2694775 | 11/1997 |
| JP | 06-146506 | 5/1994 |
| JP | 09228592 | 9/1997 |
| JP | 2000-008559 | 1/2000 |
| KR | 890010803 | 7/1989 |
| KR | 1998-016228 | 6/1998 |
| WO | WO9953157 | 10/1999 |

* cited by examiner

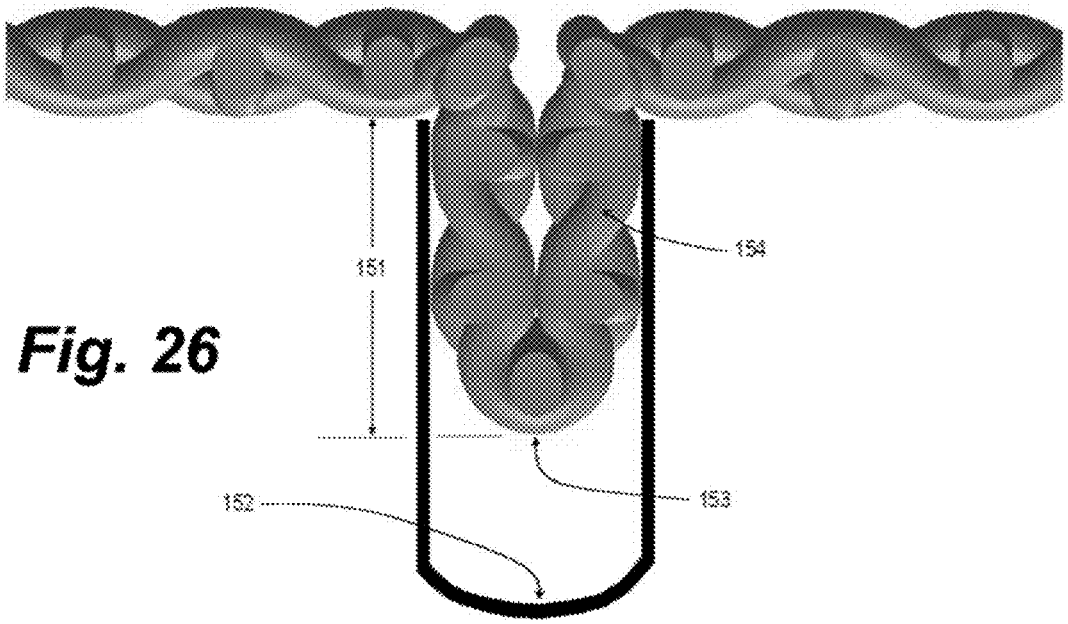
Fig. 26
Fig. 27
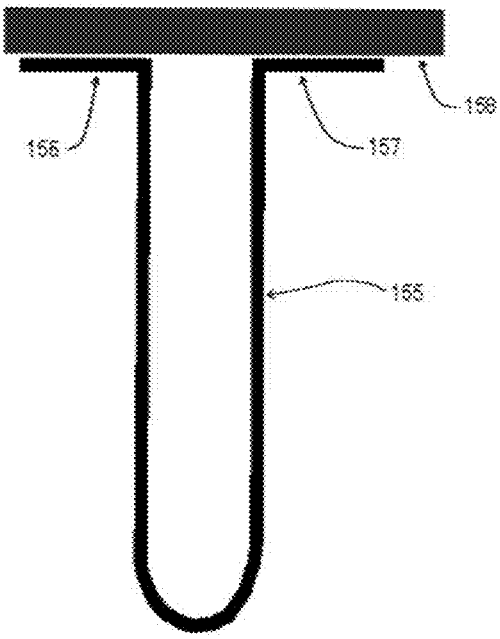
Fig. 28
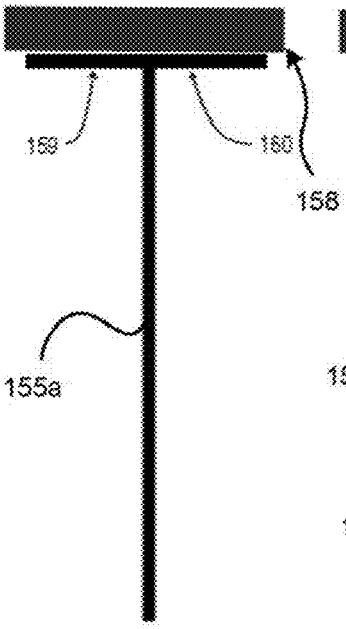
Fig. 29
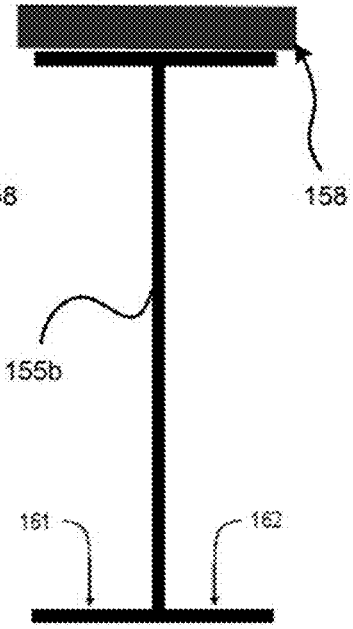

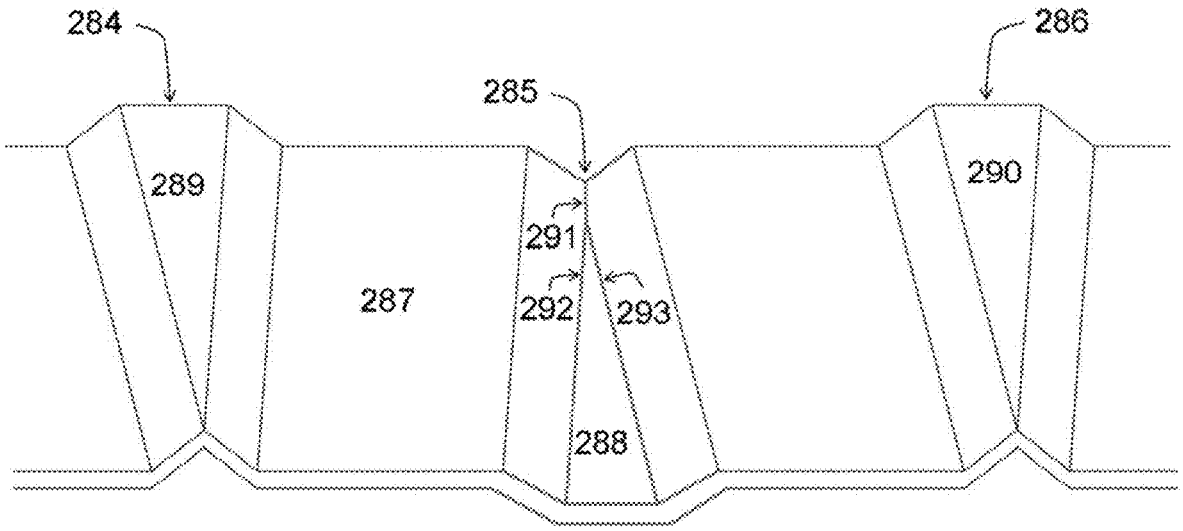
Fig. 89
Fig. 90
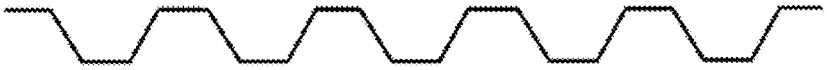
Fig. 91
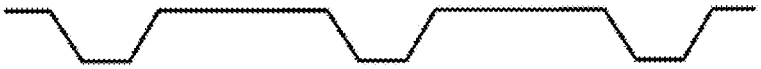
Fig. 92
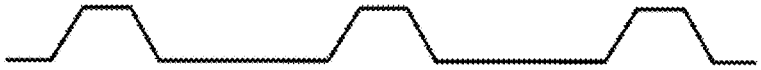
Fig. 93
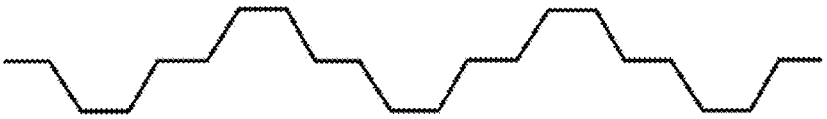
Fig. 94
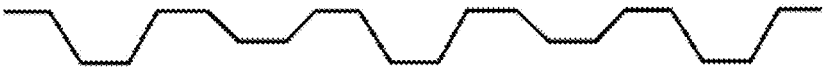

GUTTER GUARD WITH GIRDER

CROSS REFERENCE TO RELATED APPLICATION(S)

This Continuation application claims the benefit and priority of U.S. patent application Ser. No. 18/063,043, filed Dec. 7, 2022 which is a continuation U.S. patent application Ser. No. 16/864,131, filed Apr. 30, 2020, which claims priority to U.S. Provisional Patent Application No. 62/841,394 filed on May 1, 2019, titled "Girder Gutter Guard"; U.S. Provisional Patent Application No. 62/841,403 filed on May 1, 2019, titled "Girder Gutter Bridge with Irregular Grooves Gutter Guard"; U.S. Provisional Patent Application No. 62/841,387, filed on May 1, 2019, titled "Bifurcated Arched Gutter Bridge Gutter Guard"; and U.S. Non-provisional patent application Ser. No. 16/862,537, filed on Apr. 29, 2020, titled "Gutter Guard with Grooves;" wherein the above-identified applications are incorporated herein by reference in their entireties.

BACKGROUND

Field

This invention relates to gutter guards and protecting gutters from having debris entering the gutter while still allowing water to flow into the gutter.

Description of Related Art

Rain gutters are generally attached to buildings or structures that have a pitched roof. The gutters are designed to collect and divert rainwater that runs off the roof. The gutter channels the rainwater (water) to downspouts that are connected to the bottom of the gutter at various locations. The downspouts divert the water to the ground surface or underground drainage system and away from the building.

Gutters have a large opening, which runs parallel to the roofline, to collect water. A drawback of this large opening is that debris, such as leaves, pine needles and the like can readily enter the opening and eventually clog the gutter. Once the rain gutter fills up with debris, rainwater can spill over the top and on to the ground, which compromises the effectiveness of the gutter, causes water damage to the home and erodes surrounding landscapes.

A primary solution to obstruct debris from entering a gutter opening is the use of debris preclusion devices, most commonly known in the public as gutter guards. Gutter guards are also generically referred to as gutter covers, eavestrough guards, leaf guards or, alternatively via the more technical terms gutter protection systems, debris obstruction device (DOD), debris preclusion devices (DPD) or gutter bridge, etc. Gutter guards/DOD types abound in the marketplace and the industry is constantly innovating to find more efficient configurations that not only keep debris, such as leaves and pine needles out of the gutter, but also keep out even smaller particles like tiny roof sand grit. Concomitant with these innovations are the challenges of achieving self-supporting systems that are simple (e.g., low cost, single piece, easy to fabricate, etc.) as well as systems designed to maintain effectiveness (e.g., durable, easy-to-install, minimal maintenance, etc.) in heavy weather conditions.

In view of the above, various systems and methods are elucidated in the following description and figures, that provide innovative solutions to one or more deficiencies of the art.

SUMMARY

The following presents a simplified summary in order to provide a basic understanding of some aspects of the claimed subject matter. This summary is not an extensive overview and is not intended to identify key/critical elements or to delineate the scope of the claimed subject matter. Its purpose is to present some concepts in a simplified form as a prelude to the more detailed description that is presented later.

As one example, one or more embodiments of the exemplary gutter debris obstruction devices, (i.e., gutter guard) are self-supporting and utilizes its own girder support.

Guard devices made in accordance with the disclosed embodiments can have the main filtering body made from a variety of materials, such as perforated sheet, micro mesh material and others.

Manufacturing costs and for improved performance, one or more embodiments of the exemplary gutter guard devices can utilize one single piece of formed perforated sheet material. The perforated sheet material can be entirely perforated or partially perforated. Further, one or more embodiments of the exemplary gutter guard devices do not require a "separate" framed support under it.

Still further, one or more embodiments of the exemplary gutter guard devices do not require attachment brackets to attach the device to a gutter or a building.

For example, in one aspect of an embodiment, a gutter guard device is provided, comprising: a bridge member composed of a sheet or micro-mesh decking material having a plurality of orifices, and having a roof side and an opposing gutter lip side; at least one girder spanning a bottom surface of the bridge member from a proximal end of the bridge member's roof side to a proximal end of the bridge member's gutter lip side; a roof attachment member attached to an end section of the roof side of the bridge member and configured to attach to a roof; and a gutter attachment member attached to an end section of the gutter lip side of the bridge member and configured to attach to a gutter lip, wherein the device is self-supporting.

In another aspect of an embodiment, the above is provided, wherein the micro-mesh material is at least one of pre-tensioned and includes inter-woven diagonal strands of material; and/or wherein the at least one girder is a plurality of girders; and/or wherein the at least one girder is composed from the decking material of the bridge member; and/or a portion of the at least one girder at the proximal ends of the bridge member, has a reduced profile; and/or wherein the reduced profile is obtained by flattening the portion; and/or wherein a structure of the at least one girder is dual-girdered having a first side joined to an opposing second side via a connecting bottom side; and/or wherein the first and second sides are disposed perpendicular to the bridge member; and/or wherein the at least one girder is disposed at an angle from the bridge member; and/or wherein the plurality of girders are equidistant from each other; and/or wherein a girder of the plurality of girders spans the bridge member in a non-orthogonal orientation; and/or wherein the at least one girder is not equidistant from both proximal ends of the bridge member; and/or wherein at least one of the roof attachment member and the gutter attachment member is attached to the bridge member proximal to the flattened portion of the at least one girder; and/or wherein at least one of the roof attachment member and gutter attachment member have a receiving center configured for securing the bridge member to the respective attachment member; and/or wherein the receiving center's securing mechanism is at least one of a plurality of teeth, tabs, inner tab and channel, outer tab and channel, and a channel; and/or the gutter attachment member is substantially T-shaped, one side of a top of the T configured for attachment to a gutter lip and an other side of the top disposed with the receiving center; and/or wherein one side of roof attachment member is blunt-shaped and the other side is disposed with the receiving center; and/or further comprising a reinforcement cover having a U shape operable to partially or completely encase the at least one girder; and/or wherein the at least one girder is formed from a different material than the bridge member's decking material; and/or wherein the at least one girder has attachment flanges to attach the at least one girder to the bridge member; and/or wherein a profile of the at least one girder is at least one of a U, T, and I; and/or further including a reinforcement member disposed between the first and second sides; and/or wherein the plurality of girders are at least one of disposed on opposite sides of the bridge member, of different heights, of different spacings from each other, at non-perpendicular angles to the bridge member, and have a lower girder portion that is at an angle with respect to an upper girder portion; and/or wherein the at least one girder has a non-constant profile along its span; and/or the plurality of girders have different depths; and/or further comprising at least one barricade disposed in the bridge member; and/or wherein the at least one barricade has a shape of at least one of a letter, circle, arrow, arc wall, bump, dimple, and polygon; and/or wherein the at least one barricade is a plurality of barricades; and/or wherein the at least one barricade is not made from the bridge member's decking material; and/or wherein a length of the at least one girder is less than a length between an end of the bridge member's roof side and end of the gutter lip side; and/or further comprising a crease disposed in the decking material in at least one of the roof side and a gutter lip side of the bridge member, the crease extending partially across the bridge member and outlining a polygonal shape; and/or further including at least one of a regular and irregular groove disposed in the bridge member between the plurality of girders; and/or wherein the at least one groove is a plurality of grooves; and/or wherein a first cross-sectional profile of the at least one groove has a shape of at least one of a hexagon, half-hexagon, triangle, box, sinusoid, off center, dip, and V; and/or wherein a second cross-sectional profile of the at least one groove has a different shape than the first cross-sectional profile's shape; and/or a second cross-sectional profile of the at least one groove has a different size than a size of the first cross-sectional profile's shape; and/or wherein a first groove of the at least one groove is in a reversed orientation to a second groove of the at least one groove; and/or an end profile of the at least one groove forms a train of angled line segments; and/or wherein the train includes a curved segment; and/or wherein the at least one girder is triangle-shaped, formed from the decking material.

In yet another aspect of an embodiment, a gutter guard is provided, comprising:

a rear beam; a decking having a plurality of orifices, a top surface and an opposing bottom surface, wherein the plurality of orifices extend from the top surface to the bottom surface, and wherein the decking has a front edge and rear edge; at least one girder disposed on the bottom surface of the decking; and a front beam, wherein the rear edge of the decking is attached to the rear beam and the front edge is attached to the front beam, and wherein the gutter guard is self-supporting.

These and other features are described in, or are apparent from, the following detailed description of various exemplary embodiments of the devices and methods according to this invention.

BRIEF DESCRIPTION OF THE DRAWINGS

Various exemplary embodiment of this invention will be described in detail, with reference to the following figures.

FIG. 26 shows an alternative embodiment of a double-girder with reduced depth.

FIG. 27 shows an alternative embodiment of a U-shaped cover having flanges.

FIG. 28 shows an alternative embodiment of a U-shaped cover that can be utilized independently as a girder.

FIG. 29 shows an alternative embodiment of an I-shaped cover that can be utilized independently as a girder.

FIG. 89 shows another alternative embodiment of an exemplary bridge portion with irregular grooves.

FIG. 90 illustrates a bridge portion having a plurality alternating irregular grooves.

FIG. 91 illustrates an exemplary bridge portion having a plurality downward irregular grooves.

FIG. 92 illustrates an exemplary bridge portion having a plurality upward irregular grooves.

FIG. 93 illustrates an exemplary bridge portion having a plurality of cross plane irregular grooves.

FIG. 94 illustrates an exemplary bridge portion having a plurality of irregular grooves with varying groove heights.

DETAILED DESCRIPTION

Figure 1:
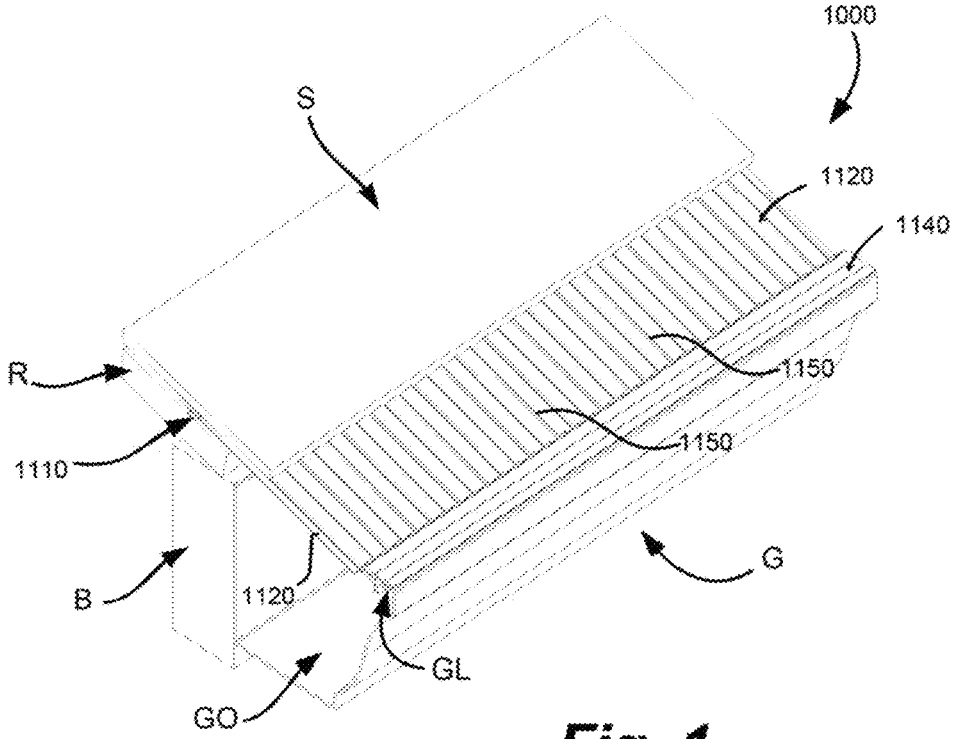
FIG. 1 is a perspective view of an embodiment of an exemplary gutter guard device attached to a gutter.

It should be appreciated that the most commonly used term to describe a debris obstruction (or preclusion) device (DOD) for a rain gutter is gutter guard. However, as stated above, alternate terms are used in the industry (generally from product branding), denoting the same or essentially same purpose of preventing or obstructing the entrance of external debris (e.g., non-water material) into the rain gutter, whereas the gutter can be protected so as to operate effectively. Thus, recognizing the layman may interchangeably use these terms to broadly refer to such devices, any such use of these different terms throughout this disclosure shall not be interpreted as importing a specific limitation from that particular "brand" or "type" of gutter device. Accordingly, while a DOD or gutter bridge may be a more technically accurate term, unless otherwise expressly stated, the use of the term gutter guard, gutter cover, leaf guards, leaf filter, gutter protection systems, gutter device, gutter guard device, and so forth, may be used herein without loss of generality.

The most conventional DOD is a one-piece gutter guard generally made of sheet materials such as plastics or metals, which tend to have very thin profiles. With such a thin profile, they do not exhibit sufficient internal support for live loads (leaves and other organic debris moving across the gutter guard), or dead loads (leaves and other organic debris sitting static on the gutter guard) and so can collapse after installation.

With the introduction of a stainless-steel type micromesh DOD, a complicated rigid frame type support was required under the micromesh to hold it up so it would not collapse under load, such as seen in U.S. Pat. Nos. 7,310,912 & 8,479,454 to Lenney and U.S. Pat. Nos. 7,191,564 & 6,951,077 to Higginbotham.

To avoid the use of complicated support or frame structures, corrugations in a stainless steel micromesh DOD were first used as seen in U.S. Pat. No. 9,021,747 to Lenney. According to dictionary definitions, corrugations consist of a series of parallel ridges and parallel grooves to give added rigidity and strength. The '747 patent's corrugations provided sufficient rigidity in the (micro) mesh itself so that it could span over the top of a gutter without collapsing.

However, self-supporting corrugated DODs tend to have a large percentage of the decking surface covered with corrugations. Some, for example, have 40% or higher of their decking surface made with these corrugations. While the corrugations provide some rigidity to the mesh, numerous conventionally designed corrugations along the longitudinal axis do not always provide enough of a permeable flat surface along the planar areas of the decking to allow debris to roll off the guard. Therefore, having a "self-supporting" gutter cover with more flat and/or permeable surfaces would address many of the problems in the prior art.

In view of the above, improved designs for allowing the mesh to span the gutter opening using supporting girders, alternative corrugation types, shapes, arrangements, mesh qualities, angles, trough/groove shapes, structures and so forth are described in the following Figures.

Figure 2:
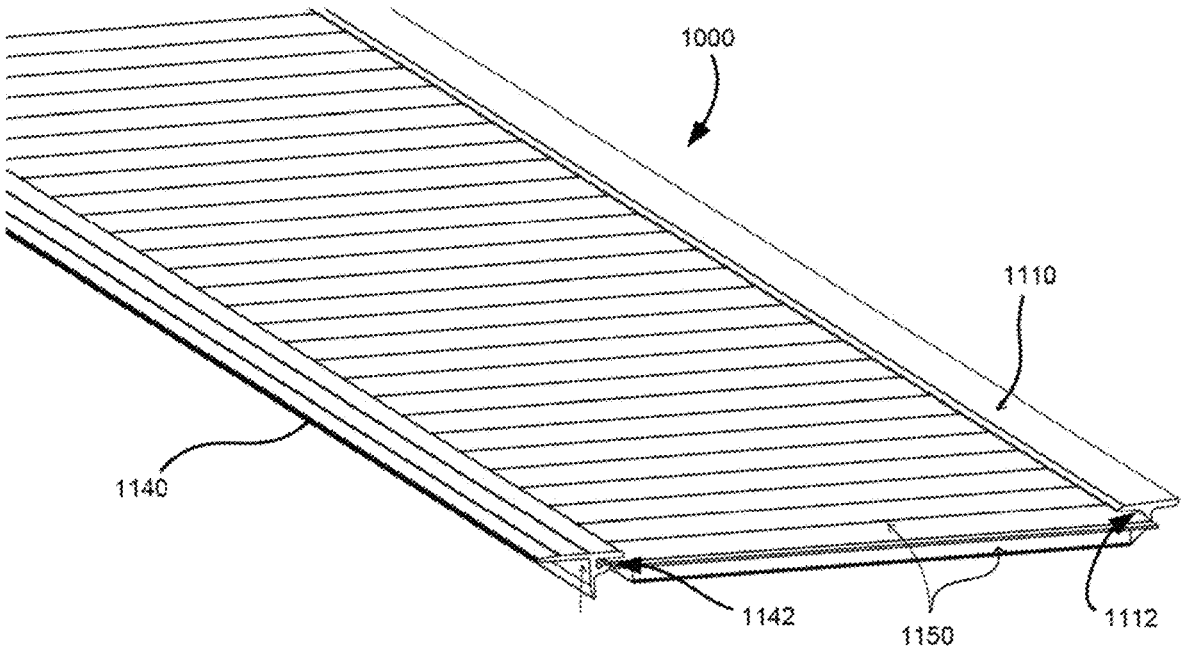
FIG. 2 is a closeup view of the embodiment of FIG. 1.

FIG. 1 displays a perspective view of an embodiment of an exemplary self-supporting gutter guard device 1000, attached to a gutter G. FIG. 2 is a closeup view of the device 1000 showing a side of an end girder 1150. As shown in FIGS. 1 and 2, the device 1000 includes a roof attachment member (hereafter referred to as roof attachment portion) 1110, a bridge member (hereafter referred to as roof attachment portion) 1120, a gutter attachment portion (hereafter referred to as roof attachment portion) 1140, and at least one girder 1150.

The bridge portion 1120 of the device 1000 is disposed between the roof attachment portion 1110 and the gutter attachment portion 1140. The bridge portion 1120 is "connected" or "secured" to the roof attachment portion 1110 via a slot 1112 along the length of the roof attachment portion 1110. Similarly, the bridge portion 1120 is "connected" or "secured" to the gutter attachment portion 1140 via a slot 1142 along the length of the gutter attachment portion 1140.

FIG. 1 shows a perspective view of the exemplary device 1000. The device 1000 is operably configured to be installed and disposed over a gutter G. The gutter will have a gutter opening GO, which without a gutter guard will readily collect debris falling from nearby trees and the roof. The gutter G is attached to the building B. The building B, the roof R and the gutter G are represented in this Fig. without great detail as any conventional elements of those items may be utilized and are only shown here to show application for the devices of the present invention. It will be appreciated that the roof R may have shingles S, which can be any type of conventional roofing material, including asphalt shingles, slate, tile roofing, etc. It will further be appreciated that the gutter G is configured to capture liquid, generally rainwater RW, that flows down the roof R and into the gutter G. The gutter G has a gutter lip GL. The device 1000, when in use is disposed above the gutter opening GO. The device 1000 is operably configured to span over the entire gutter opening GO. The device 1000 extends from the roof R to the gutter lip GL. The device 1000, along with other embodiments, will allow rainwater RW, not shown, to pass from a top surface of the device 1000 through the device 1000 and into the gutter G, while preventing a substantial amount of debris from falling into the gutter G. Additionally, the device 1000, along with other embodiments, will enable nearly all of the rainwater RW to fall into the gutter G and not run over the gutter lip GL. The device 1000 is shown in this figure to be installed onto the building B, which, in this embodiment, is "in-line" or at an acute angle with the roof's R slope angle.

The bridge portion 1120 is in this embodiment can be a micromesh material having orifices therein. In some embodiments, the micromesh material is a stainless-steal micromesh. The roof attachment portion 1110 and the gutter attachment portion 1140 can be made from aluminum, if so desired. For purposes of clarity, the orifices in the bridge portion 1130 are not shown in this Fig. and in subsequent Figs. but are understood to be present. It should be appreciated that other materials may be utilized for each of the portions of the device.

Figure 3:
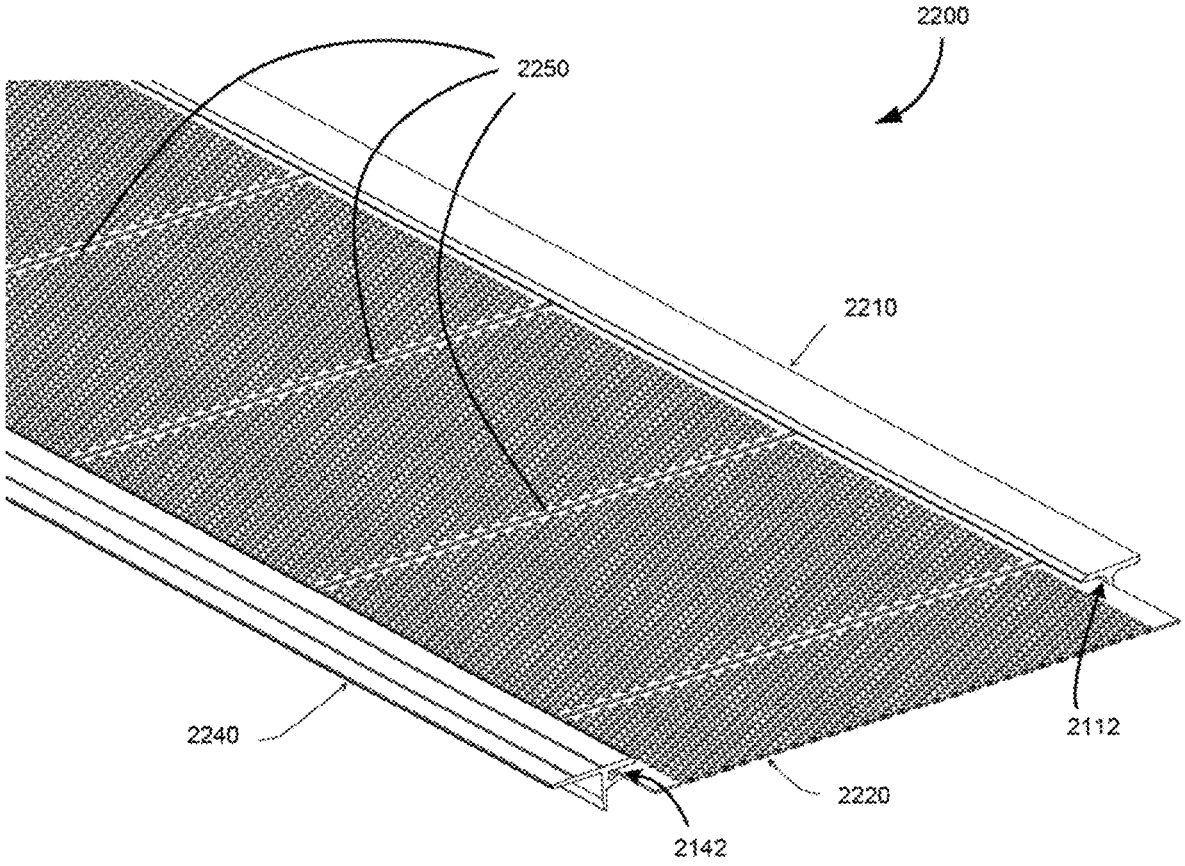
FIG. 3 displays a partial front perspective view of an exemplary device.

FIG. 3 displays a partial front perspective view of an embodiment of an exemplary device 2200. The device 2200 includes a roof attachment portion 2210, a bridge portion 2220, a gutter attachment portion 2240 and at least one girder 2250 (a top side view, the girder body obstructed from view by the bridge portion 2220). In this embodiment, the bridge portion 2220 can be made from a perforated sheet material, a non-limiting example being aluminum. The bridge portion 2220 can, in some embodiments, be "attached" or "secured" to the roof attachment portion 2210 and gutter attachment portion 2240 via slots 2112 and 2142, respectively.

Figure 4:
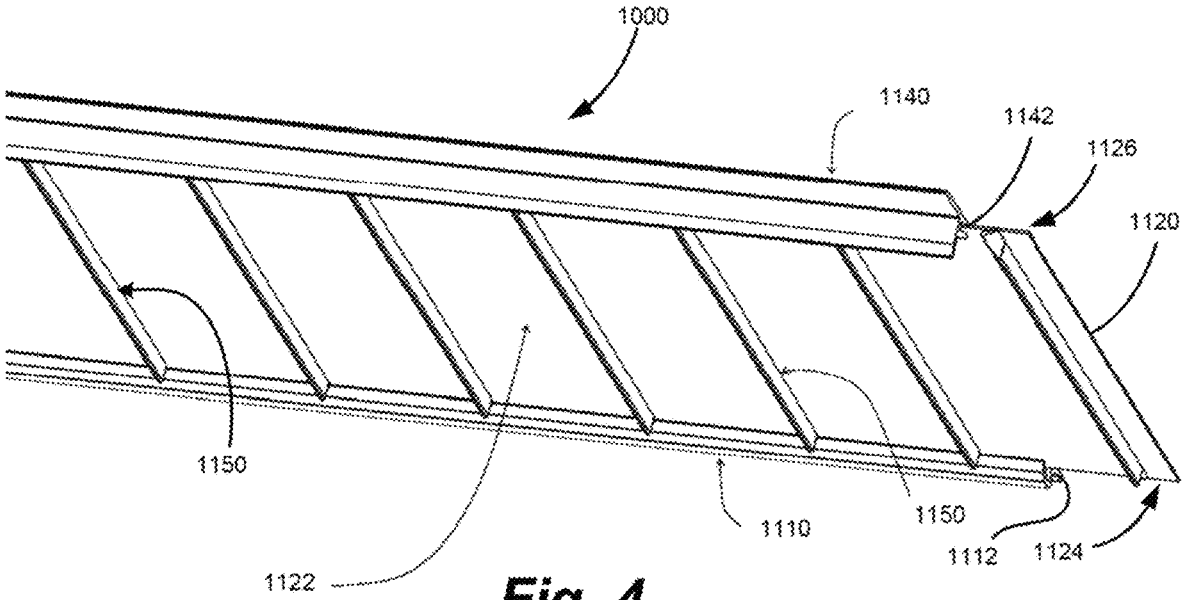
FIG. 4 displays a bottom perspective view of the embodiment of FIG. 1.

FIG. 4 displays a bottom perspective view of the device 1000 shown in FIG. 1. A plurality of girders 1150 provide support for the device 1000 to span the gutter opening (see FIG. 1). The girders 1150 are disposed on a lower (or bottom) surface 1122 of the bridge portion 1120. The bridge portion 1120 also has an opposing upper surface 1125. The girders 1150 extend from a front edge 1124 of the bridge portion 1120 to a rear edge 1126 of the bridge portion 1120. The bridge portion 1120 acts as a bracing system between the girders 1150 allowing them to act together as a support unit.

The roof attachment portion 1110, when in use is operably configured to be attached to the building B. In this exemplary embodiment, the roof attachment portion 1110 is disposed under the shingles S on the roof R, when the device 1000 is in use as shown in FIG. 1. It will be appreciated that in other exemplary embodiments, the roof attachment portion 1100 can be directly affixed to the building B with conventional fasteners. The roof attachment portion 1100 can include a slot 1112 (See FIG. 2). Therefore, the rear edge 1126 of the bridge portion 1120 can operably be configured to engage the slot 1112 for securing or fixing thereto. The roof attachment portion 1110 can be a resilient material, such as plastic, metal, and so forth. Accordingly, a suitably configured aluminum rail can suffice to receive the bridge portion 1120.

The bridge portion 1120 can be made from a micromesh material, which inherently creates voids between its intercrossing wires. The bridge portion 1120 provides bracing support for the plurality of girders 1150. The bridge portion 1120 also laterally connects adjacent girders 1150. This girder-to-bridge-to-girder interconnection of the girders 1150 enhances the overall strength of the device 1000 and further prevents deflection of the device 1000 when spanning the gutter.

The gutter attachment portion 1140 is operably configured to be fastenable to the gutter G when the device 1000 is in use. The gutter attachment portion 1140 will overly the gutter lip GL of the gutter G. It will be appreciated that a variety of conventional fasteners may be utilized to fasten the gutter attachment portion 1140 to the gutter lip GL, such as but not limited to screws, rivets, double sided tape, etc. As discussed in FIG. 2, the gutter attachment portion 1140 includes a slot 1142 for fitment with the front edge 1124 of bridge portion 1120. The gutter attachment portion 1140 can be a resilient material, such as plastic, metal, and so forth. Accordingly, a suitably configured aluminum rail can suffice to receive the bridge portion 1120.

The at least one girder 1150 are shown as a plurality of girders 1150 and are formed in bridge portion 1120. In this exemplary embodiment, the girders 1150 are disposed across about the entire bridge portion 1120. It will be appreciated that in other embodiments, the girder only partially spans the bridge portion. Further, the girders 1150 in this embodiment are shown as parallel, however other orientations are possible.

It is understood that the girders described herein are differentiated from corrugations, the former generally being a vertical-like structure with no (or little) consideration for permeability to water, its primary purpose being for providing support. Thus, girder formations allow a significant span between each other, as opposed to corrugations alone.

Figure 5:
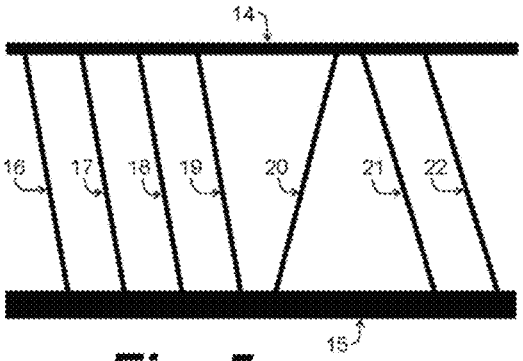
FIG. 5 show a possible layout of girders for alternate embodiments of an exemplary device.

FIGS. 5-8 show bottom views of various possible layouts of girders for alternate embodiments of an exemplary device. FIG. 5 shows girders 16, 17, 18, 19, 20, 21 and 22 extending from a roof attachment portion 14 (can also be referred to as the back floor beam) and a gutter attachment portion 15 (can also be referred to as the front floor beam). These girders are slanted or angled from the back to the front under the decking of the bridge portion (not shown), which is disposed to the front 15 and back 14 portions. Girders can also be positioned in an opposite direction/angle to each other as shown with girders 19, 20 and 21.

It is understood that in various embodiments described herein, all or most of the bridge portion is composed or made from a decking material. The decking material being a sheet material or mesh material, etc. is part of the bridge portion in the exemplary device. Therefore, when this disclosure refers to the decking material, it is understood that the reference inherently applies to the exemplary device's bridge portion and, therefore the term decking material and bridge portion may be used interchangeably within the context being described.

Figure 6:
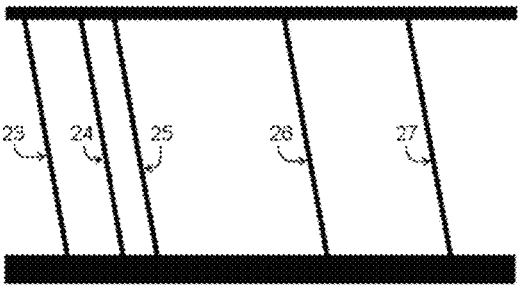
FIG. 6 shows girders which are spaced unevenly to each other.

FIG. 6 shows girders 23, 24, 25, 26 and 27, which are spaced unevenly to each other.

Figure 7:
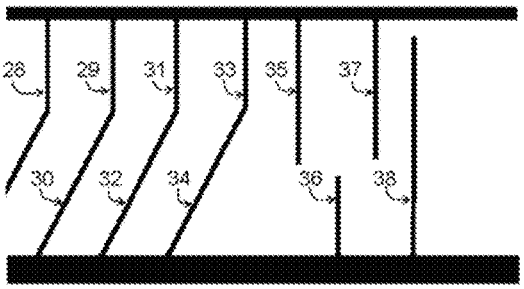
FIG. 7 shows girders that are not linear in direction, shape or form.

FIG. 7 shows that girders do not have to be linear in direction, shape or form, as seen, for example, with girders section 28, 29, 31 and 33, having directional changes corresponding to section 30, 32 and 34. Girders 35, 36, 37 and 38 can extend partially across the bridge portion, and can also vary in length relative to one another.

Figure 8:
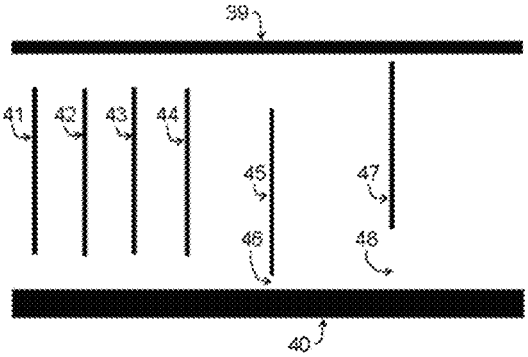
FIG. 8 shows girders that do not extend fully across the bridge portion.

FIG. 8 shows girders 41, 42, 43 and 44 that do not extend fully across the bridge portion, nor do they connect to the back beam 39 or the front beam 40. Girders 45 and 47 vary in distances 46 and 48, respectively, from the front beam 40. The distance 46 is less than the distance 48 and the girders can also vary in length relative to one another.

Figure 9:
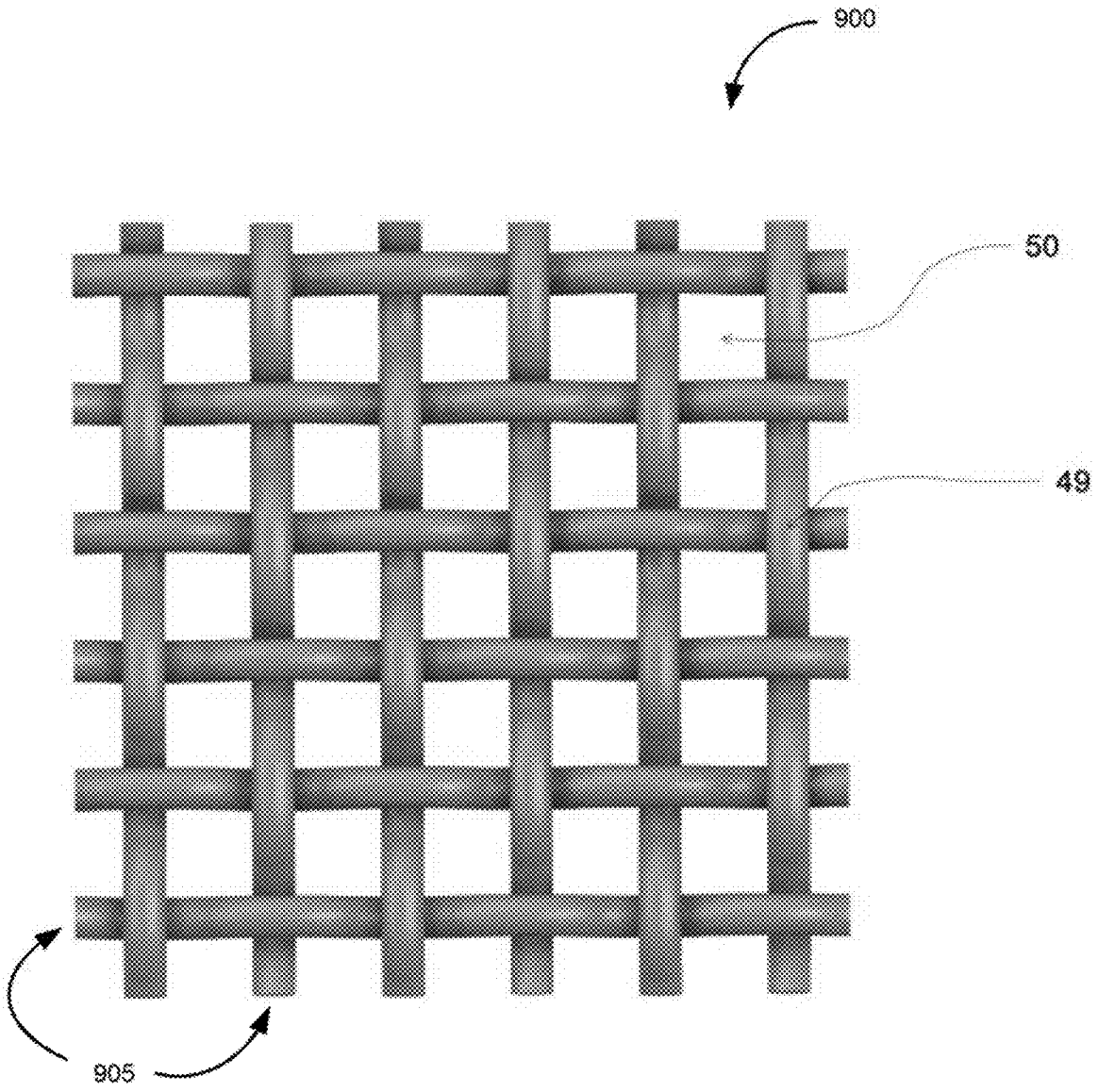
FIG. 9 shows a partial top view of micromesh.

FIG. 9 shows a partial top view of micromesh 900 that can be used for a bridge portion in exemplary devices. The micromesh 900 is shown as having orthogonally plane woven micromesh wires 905 crossing each other at ninety-degree angles along all intersecting nodes as in node 49, and creates stable configured quadrilateral square units, or holes, as shown in 50. This material can be used to form the girders in various exemplary devices. Girders made with such a material are an unconventional type of girder, because the shape of the micromesh holes are square and open, as opposed to conventional large rolled steel plates or plated girders in a bridge structure that are solid and not open.

The micromesh 900 can also be tensioned for additional strength during the forming process in manufacturing. The tensioning process during manufacturing creates a stiffness in the micromesh 900 and slightly increases the length. Tensioned wires are less likely to be compromised under increased loads on the micromesh decking because the woven wires are no longer pre-disposed to flexing due to loads exerted on the decking material. Stretched or tensioned woven wires reduces the flexible droopiness and sagging that can exist in the micromesh decking. Tensioned dual-girder micromesh allows for a more rigid vertical and horizontal cross wires.

Figure 10:
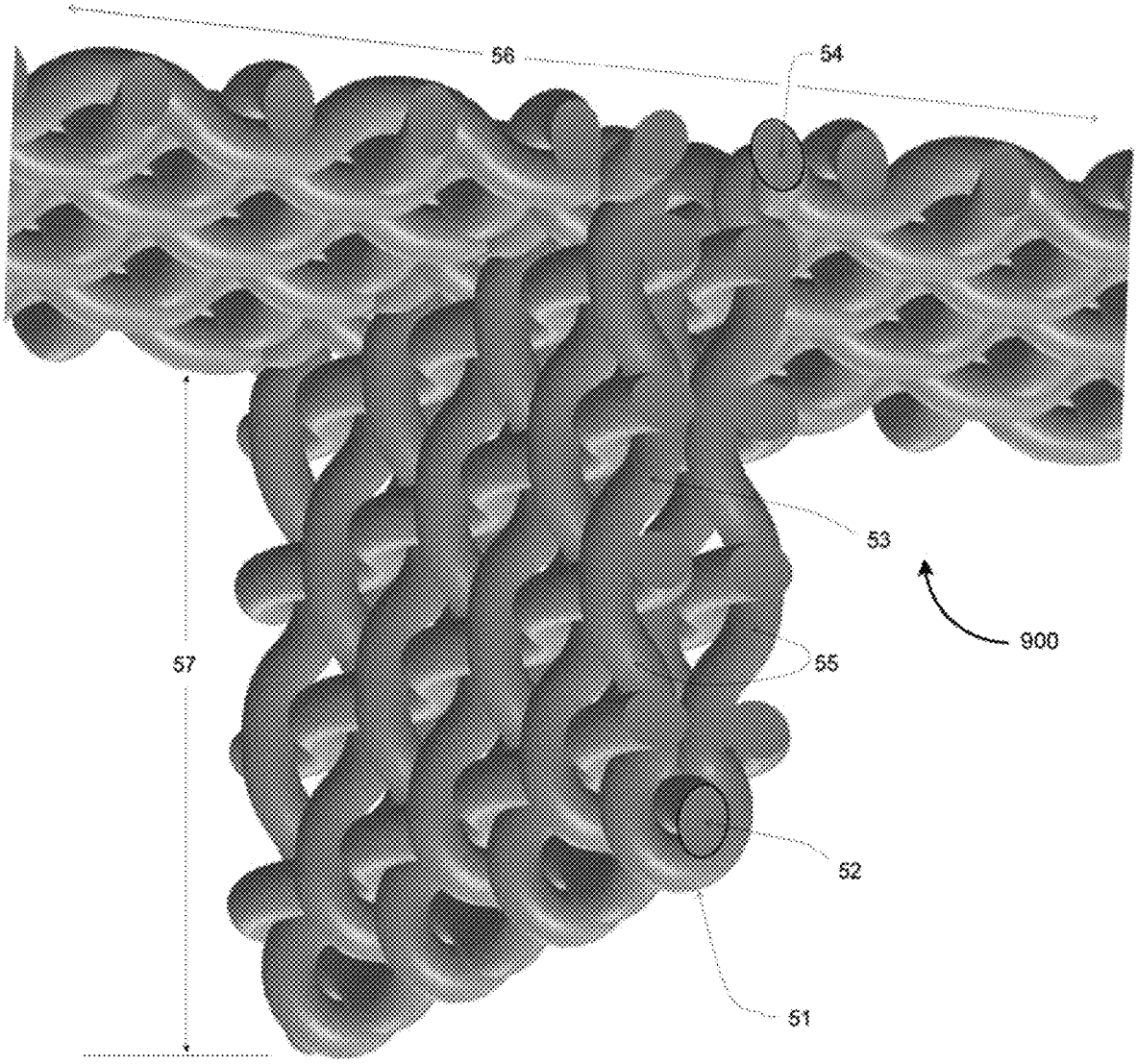
FIG. 10 shows a sample girder formed from micromesh material.

FIG. 10 shows a sample girder 55 formed, for example, from the micromesh material 900 discussed in FIG. 9. To form a strong girder for supporting the bridge portion, the micromesh decking material 900 is folded 51 over itself 180 degrees at the bottom chord 52 or close to it, then firmly pressing against the adjacent girder 53 then up to the top chord 54 or close to it. The micromesh girder 55 is now a reinforced double-structured girder shaped like a "T". The micromesh double-structured girder 55 acts as a single united perpendicular, or substantially perpendicular or angled support girder, joined and formed to the longitudinal decking 56 of the bridge portion. The double-structured girder in FIG. 10 can have a depth 57 of less than 1 inch and can run, for example, transversely from the front of the gutter to the back of the gutter and edge of the roof, when in an installed state (not shown).

Figure 11:
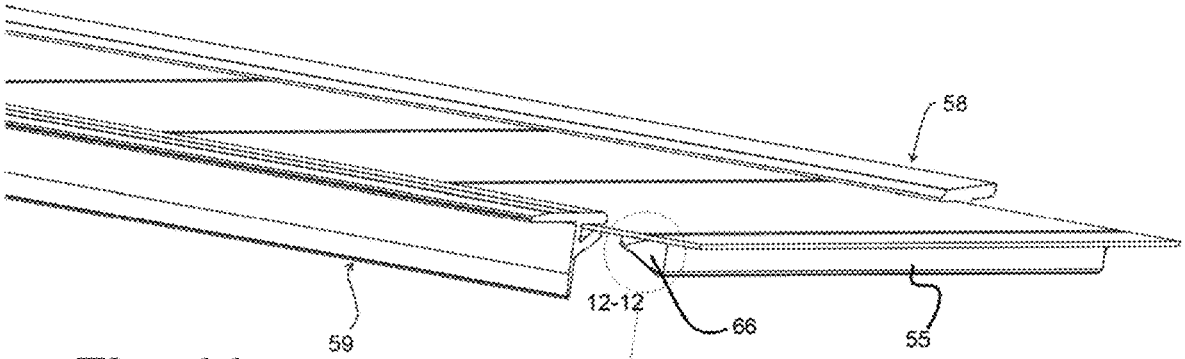
FIG. 11 shows an embodiment of an exemplary device with tapered girders.

FIG. 11 shows an embodiment of an exemplary device with girders 55 of FIG. 10 having an end(s) 66 with a tapered down configuration. The taper down end(s) [60] 66 are connected to the back 58 and front 59 floor beams. The tapering can be in the form of a bend in the end 66, bringing the end "towards" to the center, for example, of the girder 55. The "tapering" can be abrupt to form a "45" degree transition at the end(s) 60 or can be gentle so as to have a longer taper. The bend can take the form of a fold of the girders 55's ends 66 as better seen in FIG. 12. Also, the resultant end(s) shape can be accomplished by shearing the end, if so desired.

Figure 12:
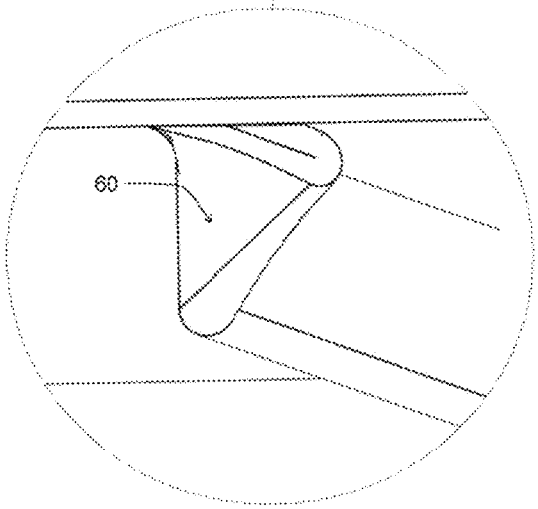
FIG. 12 is a blown up view of the circle 12-12 in FIG. 11.

FIG. 12 is a blown up view of the circle 12-12 in FIG. 11, illustrating the girder end 66 tapered down 60, producing a reduced girder "height" to result in a shape similar to a non-curved arch. Of course, the resultant shape may be other than what is shown. While FIGS. 11 and 12 show the direction of the tapering (or folding) in an "outward" orientation, it can be in either direction, whether inward or outward.

Figure 13:
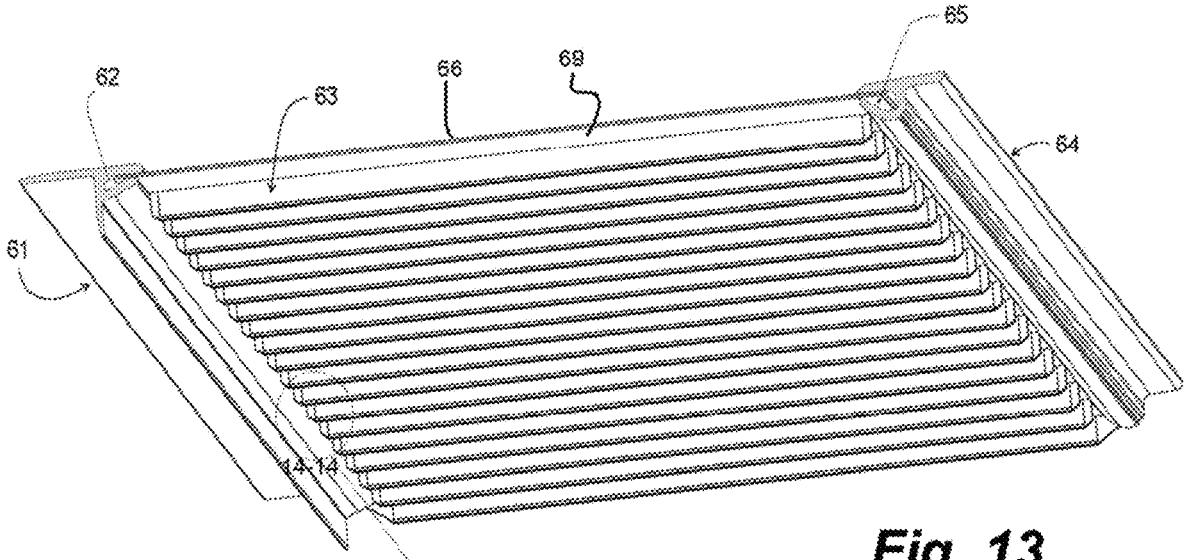
FIG. 13 is an underside view showing a front floor beam with a receiving center.

FIG. 13 is an underside view of an embodiment of an exemplary device, showing a front floor beam 61 having a receiving center 62 (also referred to as a slot, or equivalent) that is connected to girder(s) 63 and a flat decked micromesh 66 of the bridge portion 69. The back floor beam 64 also has a receiving center 65 (also referred to as a slot, or equivalent) for receiving the back end of the flat decked micromesh 66 of the bridge portion 69.

Figure 14:
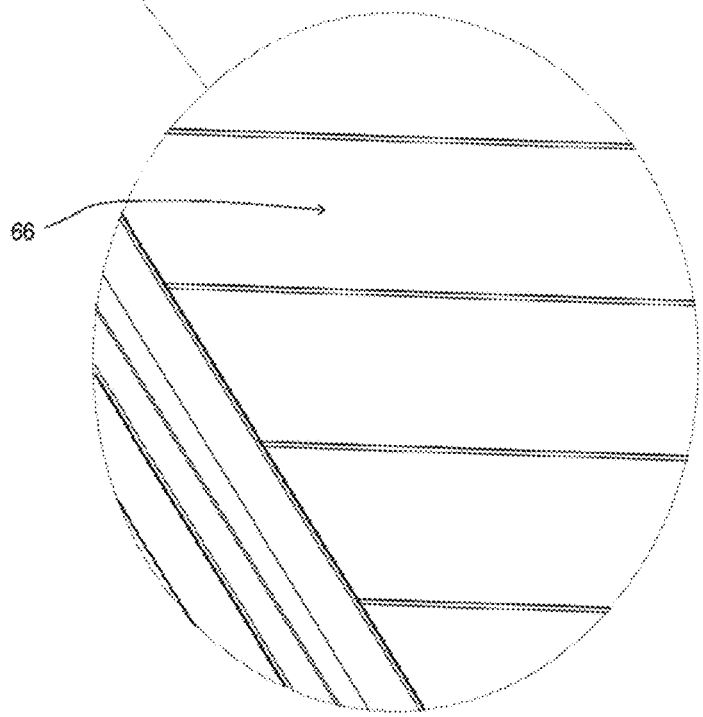
FIG. 14 is a close-up of the underside of the embodiment shown in FIG. 13.

FIG. 14 is a close-up of the underside of the flat decked micromesh decking 66 shown in FIG. 13.

It is expressly understood that the gutter attachment portion (front floor beam) and the roof attachment portion (back floor beam) described in the Figs. herein can, in various embodiments, be connected to the bridge portion through a variety of optional methods including, but not limited to, crimping, riveting, gluing or adhesive, etc. in order to lock them together. The floor beams can be formed into different shapes and made from a variety of materials including aluminum, steel or any type of plastic, and so forth.

Figure 15:
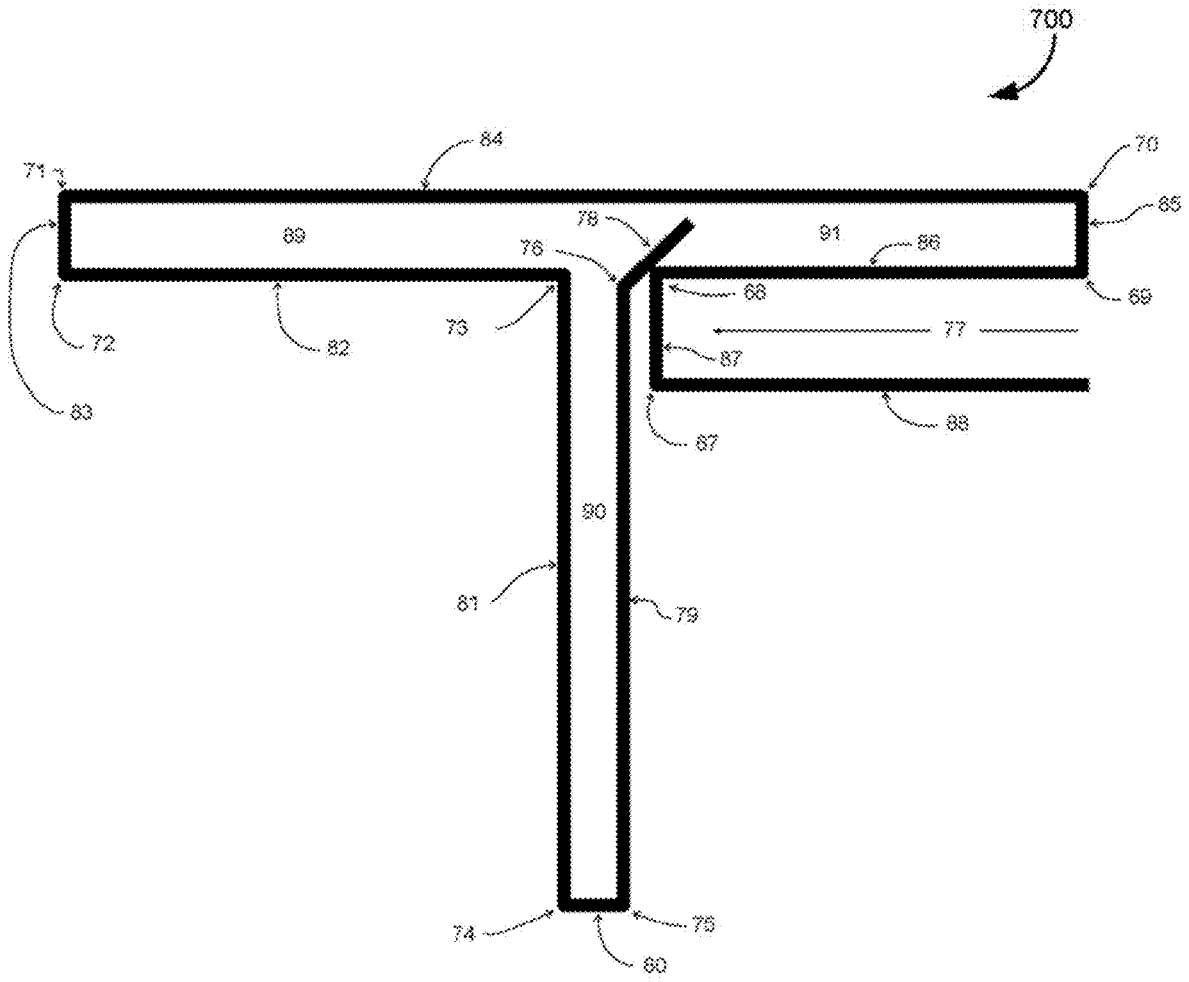
FIG. 15 shows a side view of an exemplary front floor beam.

FIG. 15 shows a side view of an exemplary front floor beam 700 applicable for use with embodiments of an exemplary device(s). Front floor beam 700 is shown with ten "corners" 67-76. It will be appreciated that other embodiments may be made with more or less than ten corners and that the corners may have different angles than shown. The receiving center 77 can be shaped like a channel or have a configuration where the decking and girders (not shown) are inserted and then later closed shut in the manufacturing process to firmly anchor the decking. An angled tab 78 is bent towards corner 68 for being locked in place. When the angled tab 78 is locked into place, it stiffens and strengthens one or more of floor beam surfaces 79-88. Open spaces 89, 89, 90 and 91 are shown between the floor beam surfaces. However, it will be appreciated that there would be little to no space between these surfaces in a produced beam, depending on the manufacturing process. The open space in this diagram is to better show the attributes and purpose of the surfaces and their interaction with each other. It will be further appreciated that in other embodiments, the interior of one more of floor beam surfaces 79-88 can have an applied adhesive, glue, foam, injectant, material or other type of adherent to assist in helping various surfaces retain rigidity. In addition to just closing shut the receiving center 77 surface 88 against upper surface 86, an adhesive, glue, foam, injectant, material or other type of adherent can be applied on a portion of or all of surfaces 86, 87 and 88 on the inner side of the receiving center 77 prior to inserting the decking material. This would provide additional locking forces to anchor the decking material in the receiving center 77.

Also, one or more of surfaces 86, 87 and 88 on the inner side of the receiving center 77 can, in some embodiments, have a process applied to them so the front floor beam 700 material is textured, gnarled, or roughened as to provide additional gripping unto the decking material when it is closed shut. This will help keep the decking material from slipping out over time. The process can be applied pre-formation or post-formation of the front floor beam 700 structure, or the desired surface "texture/shape" can be inherent to the front floor beam 700 material being used. Further, one or more of surfaces 86, 87 and 88 on the inner side of the receiving center 77 can partially or fully have creases with ridges or radiuses formed into the material as shown, for example, in FIGS. 16 and 17. Additionally, one or more of surfaces 80, 83 and 85 can, in some embodiments, be convex or radiused outwardly, facing away from the front floor beam 700.

It is understood that a crease may appear as a groove and does exhibit some of the attributes of a groove, however, it is localized to the ends of the decking, extending inward only so as to provide the necessary balancing of the mesh material.

Figure 16:
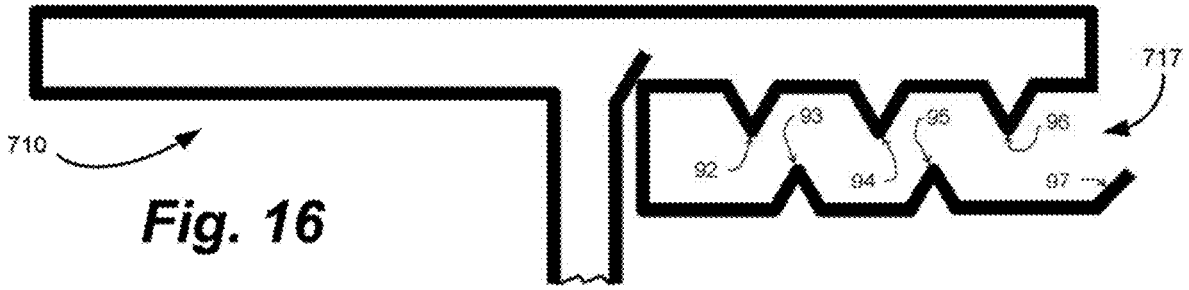
FIG. 16 shows an alternative embodiment of a receiving center for a front floor beam, with one or more triangle shaped teeth.

FIG. 16 shows an alternative embodiment of a receiving center 717 of a front floor beam 710, wherein it has one or more triangle shaped teeth 92, 93, 94, 95, 96 and 97. These teeth help grip the decking material when closed shut. It will be appreciated that these teeth can have several optional shapes including hexagon, box, sinusoidal, off center, dome or other. Further, there can be more or less than five teeth in the receiving center 717. Additionally, the teeth can be formed in different locations throughout the receiving center 717. The outward hook 97 can operate to wedge itself against the decking material when the receiving center 717 is closed (for example, by natural tension or via crimping, etc.). The teeth and/or the hook help to grip the decking material of the bridge portion to help hold it in place.

Figure 17:
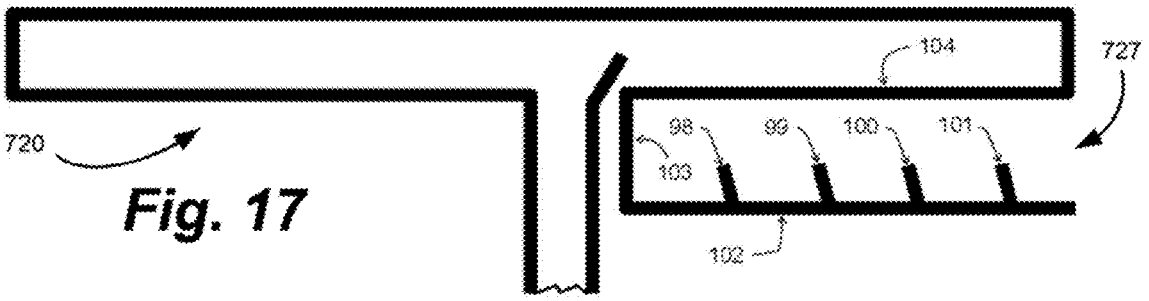
FIG. 17 shows an alternative embodiment of a receiving center with one or more pierced lifted perforation tabs.

FIG. 17 shows an alternative embodiment of a receiving center 727 of a front floor beam 720, wherein it has one or more pierced lifted perforation tabs 98-101 connected at the base of the receiving center floor 102 that can help grip the decking material when closed shut. It will be appreciated that the lifted perforation tab(s) can be parallel or non-parallel, perpendicular or non-perpendicular to the longitudinal axis of the front floor beam 720. Further, there can be more or less than four lifted perforation tabs in the receiving center 727. The lifted perforations can be formed in different locations throughout the receiving center surfaces including, for example, the bottom 102, back side 103 and top 104.

Figure 18:
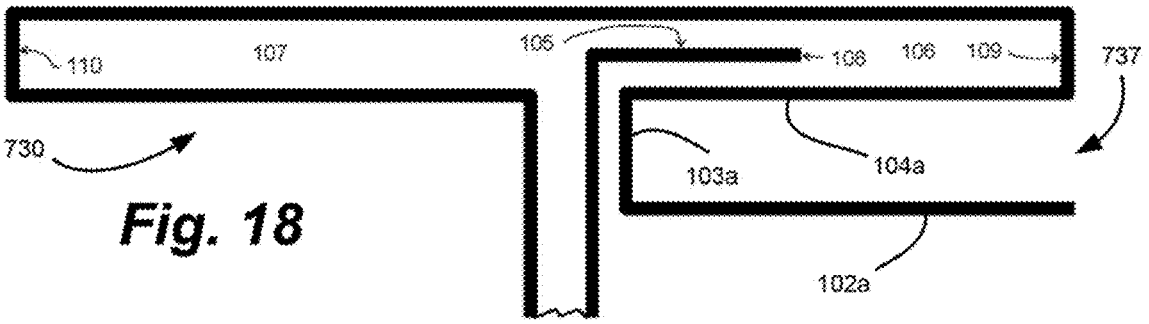
FIG. 18 shows an example of a front floor beam where the inner tab is not angled.

FIG. 18 shows a cross sectional view of a front floor beam 730 where an inner tab 105 of a receiving center 737 does not need to be angled. Rather, it can form itself inside the upper interior surfaces on a right side open space 106, or it can form itself in the left side open space 107. Further, a tip 108 of the tab 105 can extend partially in either the space 106 or 107, or fully against surfaces 109 or 110. It should be noted that sides 104*a* and 102*a* are shown as being approximately parallel, however, in various embodiments, they be slightly off-parallel, narrowing towards side 103*a* or vice versus.

Figure 19:
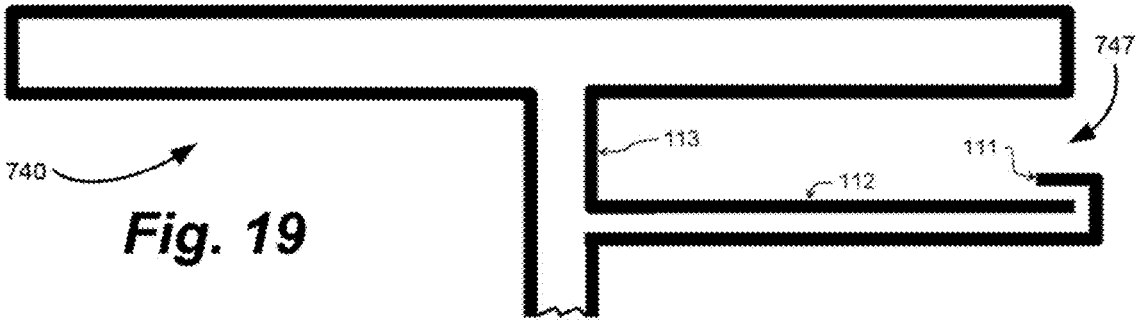
FIG. 19 shows an example of a front floor beam where the outward tab is disposed in the receiving center.

FIG. 19 shows a cross sectional view of a front floor beam 740 wherein a receiving center 747 has an outward tab 111 disposed in the receiving center 747. The tab 111 extends around a bottom surface 112. It will be appreciated, that the end of the outward tab 111 can extend partially or all the way across surface 112 and be positioned adjacent to surface 113, the back of the receiving center 747.

Figure 20:
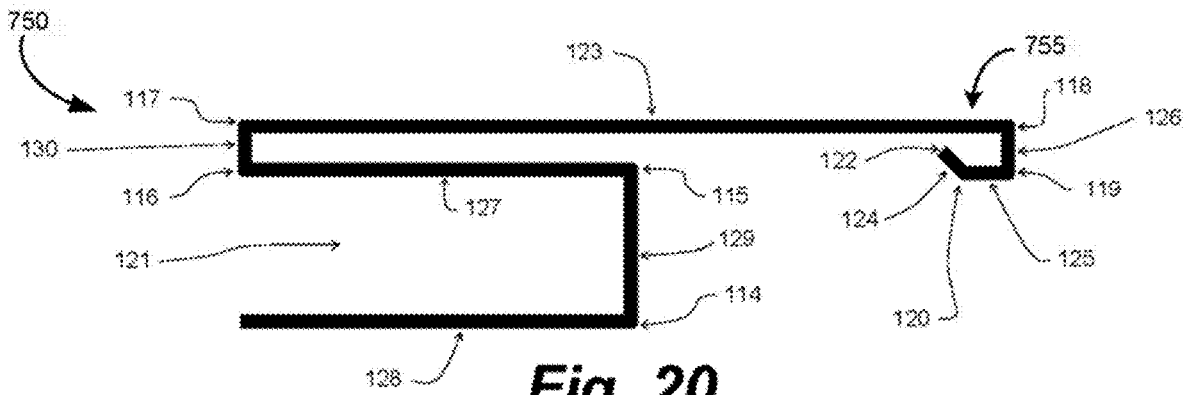
FIG. 20 shows an exemplary roof attachment portion.

FIG. 20 shows a cross-sectional view of an exemplary roof attachment portion (back floor beam) 750. In this embodiment, the beam 750 has seven corners 114, 115, 116, 117, 118, 119 and 120. It will be appreciated that in other exemplary embodiments, the back floor beam 750 can be made with more or less than seven corners. A receiving center 121 can be shaped like a channel or have a configuration to receive the decking of the bridge portion (not shown) and then later closed shut in the manufacturing process to firmly secure the bridge portion. On the other side of the back floor beam 750, a back angled tab 122 is bent towards a top surface 123. The back tab 122 can be close to the surface 123 or adjacent to it. The back section 755 of 122, 124, 120, 125, 119, 126 and 118 form a "non-jagged" edge so it can slide easily under the roof shingles by the installer. Not having a sharp back section 755 edge helps to avoid ripping the roofing paper beneath the shingles. In other embodiments, the back section 755 can obtain a non-sharp edge by curling, rolling, blunting the terminal end of the back section 755. The degree of curling or blunting chosen can be design dependent.

While FIG. 20 shows an open space between surface 123 and 127 of the back floor beam 750, it will be appreciated that there will be little to no space between these surfaces once the device is produced due to the manufacturing process. The open space in this diagram is to better show the attributes and purpose of the surfaces and their interaction with each other. It will be further appreciated that the interior of back floor beam surfaces 123 and 127 can have an applied adhesive, glue, foam, injectant, material or other type of adherent to assist in helping the walls retain rigidity. Further, in addition to just closing shut the receiving center 121 surface 128 against upper surface 127 an adhesive, glue, foam, injectant, material or other type of adherent can be applied on a portion of or all of surfaces 127, 128 and 129 on the inner side of the receiving center 121 to inserting the decking material. This would provide additional locking forces to anchor the decking material in the receiving center 121. In addition, it will be appreciated that surfaces 127, 128 and 129 on the inner side of the receiving center 121 can be a gnarled surface. The surfaces can have a pre-process applied to them so the material is textured, gnarled or roughened as to provide additional gripping unto the decking material when it is closed shut. This will help keep the decking material from slipping out over time. The process can be pre-formation or post-formation of the back floor beam 750 structure, or the desired surface "texture/shape" can be inherent to the back floor beam 750 material being used.

Figure 21:
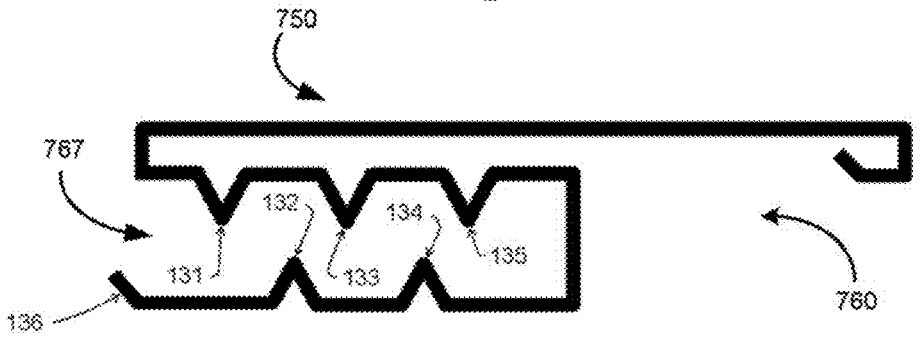
FIG. 21 shows an alternative embodiment of a receiving center for a back floor beam with triangle shaped teeth.
Figure 22:
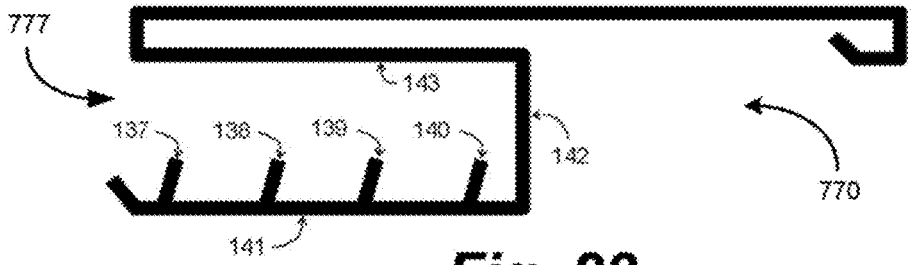
FIG. 22 shows an alternative embodiment of a receiving center with pierced lifted perforation tabs.

It will also be appreciated that the surfaces 127, 128 and 129 on the inner side of the receiving center 121 can partially or fully have creases with ridges or radiuses formed into them as shown in, for example, FIGS. 21 and 22. Surfaces 126, 129 and 130 can also be concaved inwardly or radiused outwardly away from the back floor beam 750.

FIG. 21 shows an alternative embodiment of a receiving center 767 of a back floor beam 760, wherein the receiving center 767 includes triangle shaped teeth 131, 132, 133, 134 and 135. The teeth are operably configured to engage and grip the decking material of the bridge when inserted therein (or when the receiving center 767 is physically "closed"). It will be appreciated that in other exemplary embodiments, these teeth can have other shapes including hexagon, box, sinusoidal, off center, dome or other. Further, there can be more or less than five teeth in the receiving center 767. Additionally, the teeth can be formed in different locations throughout the receiving center surfaces. Also, the outward hook 136 can be configured to wedge itself against the decking material when the receiving center 767 is closed (for example, by natural tension or via crimping). The teeth and/or the hook operate to grip the decking material to help hold it in place.

FIG. 22 shows an alternative embodiment of a receiving center 777 of an exemplary rear/back floor beam 770. This receiving center 777 is shown with pierced lifted perforation tabs 137, 138, 139 and 140 connected at the base of the receiving center floor 141. These tabs operate to engage and help grip the decking material of the bridge portion when closed (by natural tension or via crimping, etc.). It will be appreciated, that the lifted perforation tabs can be parallel or non-parallel, perpendicular or non-perpendicular to the longitudinal axis of the rear floor beam 770. Further, there can be more or less than four lifted perforation tabs in the receiving center 777. Additionally, the lifted perforations can be formed in different locations throughout the receiving center surfaces including the bottom 141, side 142 and upper surface 143.

Figure 23:
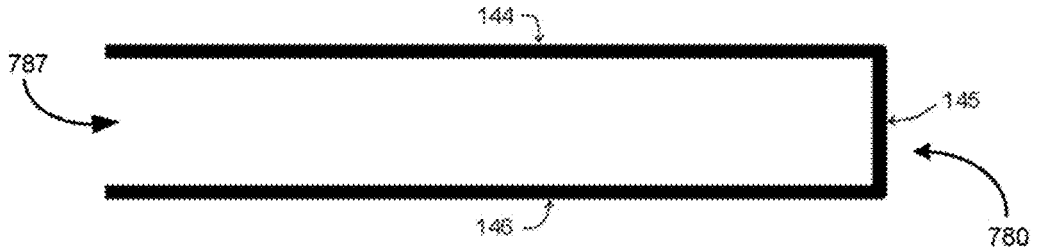
FIG. 23 shows an alternative embodiment of a receiving center with a "U" configuration.

FIG. 23 shows an alternative embodiment of a receiving center 787 of an exemplary rear floor beam 780. This receiving center 787 can be shaped like sideways "U" with only three sides 144, 145 and 146. Sides 144 and 146 are shown as being approximately parallel, however, in various embodiments, they be slightly off-parallel, narrowing towards side 145 or vice versus. The receiving center 787 can be modified with one or more attributes as those from FIGS. 20, 21 and 22.

Figure 24:
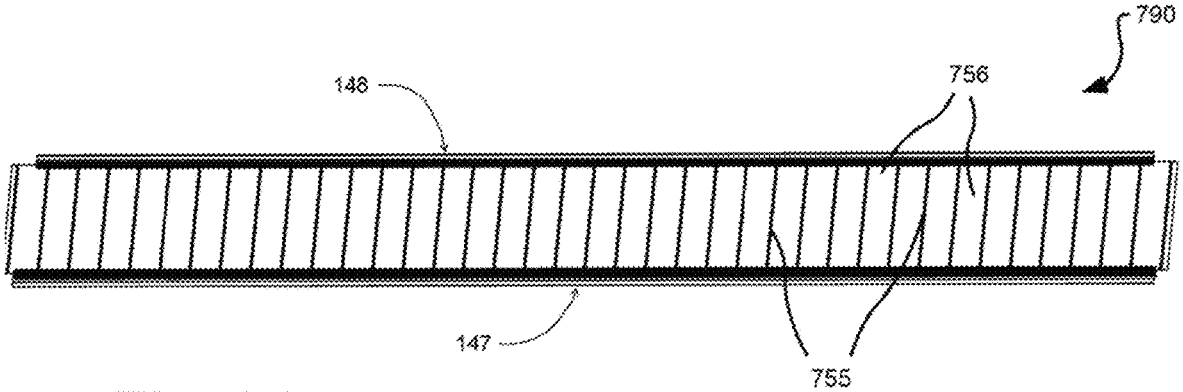
FIG. 24 shows a bottom view of an exemplary device with front and back floor beams.

FIG. 24 shows a view of an exemplary device 790 with floor beams that run longitudinal in the front 147 and longitudinal along the back 148 of device 790. The floor beams operate to "lock" the girders 755 and the flat areas 756 of the micromesh between them. Because of the unusually strong performance of the girders 755 (see FIG. 10's girders formed from the micromesh), only girder support is needed up to every two inches or more along the micromesh surface to provide adequate rigidity for spanning a five-inch wide gutter, for example.

In various embodiments, the width of the mesh-formed girder (or double-girder) can be approximately 0.08 inches and the depth and can be approximately 0.125 inches, which represents less than 4% of the total area of the micromesh decking. This leaves 96% of the micromesh planar surface flat. That equates to over 30% more efficient than traditional corrugated gutter guards. Further, the depth of a double-girder increases the dynamic load capacity and allows for extended lengths of the micromesh decking from the longitudinal front of the gutter to the longitudinal back of the gutter. This gives the exemplary devices the ability to span gutters up to 12 inches or more. As an example of the performance, Chart A shows Girder-Depth To Girder-Length Ratios for making calculations of how long a double-girder can be when providing the support for the micromesh decking for covering wider gutter widths. The chart shows acceptable specifications for these ratios. The height is understood as the vertical dimension from the double-girder's bottom edge to the underside of the bridge. Also, it is understood that the following Tables refer to the double-girder as "girder."

TABLE A

| Girder Height: | Girder Length: | Covers Gutter Width of: |
|---|---|---|
| 0.125 inches | 5.5 inches | 5 inches |
| 0.157 inches | 6.5 inches | 6 inches |
| 0.189 inches | 7.5 inches | 7 inches |
| 0.221 inches | 8.5 inches | 8 inches |
| 0.253 inches | 9.5 inches | 9 inches |
| 0.285 inches | 10.5 inches | 10 inches |
| 0.317 inches | 11.5 inches | 11 inches |
| 0.349 inches | 12.5 inches | 12 inches |

NOTE:
Distance between girders is 4 inches.

As shown in Table A, as the double-girder increases in width by one inch, the height of the double-girder increases by about 0.032 inches. These values were based on a sheet mesh material having an average orifice size of 0.023 inches with an orifice density of 900 orifices per square inch.

Table B provides examples of double-girder-height to double-girder-distance from each other ratios on a 5 inch gutter. Because deeper double-girders increase the dynamic load capacity, they also allow for greater distances from each other on the micromesh decking. This allows for fewer double-girders under the micromesh decking which in turn provides greater area of planar micromesh decking. Fewer double-girders also equates to less micromesh decking material needed to form these double-girders which reduces overall costs in manufacturing. It will be appreciated that as each double-girder increases in height by 0.032 inches, the distance between double-girders increases by 0.25 inches.

TABLE B

Girder-Height To Girder-Distance From Each Other Ratios On A 5 Inch Gutter

| Gutter Width: | Girder Height: | Distance between adjacent Girders |
|---|---|---|
| 5 inches | 0.125 inches | 2 inches |
| 5 inches | 0.157 inches | 2.25 inches |
| 5 inches | 0.189 inches | 2.5 inches |
| 5 inches | 0.221 inches | 2.75 inches |
| 5 inches | 0.253 inches | 3 inches |
| 5 inches | 0.285 inches | 3.25 inches |

Table C provides examples of double-girder-height to double-girder-distance from each other ratios on a 6 inch gutter. It will be appreciated that as each double-girder increases in height by 0.032 inches, the distance between double-girders increases by 0.18 inches.

TABLE C

Girder-Height To Girder-Distance From Each Other Ratios On A 6 Inch Gutter

| Gutter Width: | Girder Height: | Distance between adjacent Girders |
|---|---|---|
| 6 inches | 0.125 inches | 2 inches |
| 6 inches | 0.157 inches | 2.18 inches |
| 6 inches | 0.189 inches | 2.36 inches |
| 6 inches | 0.221 inches | 2.54 inches |
| 6 inches | 0.253 inches | 2.72 inches |
| 6 inches | 0.285 inches | 2.9 inches |

Figure 25:
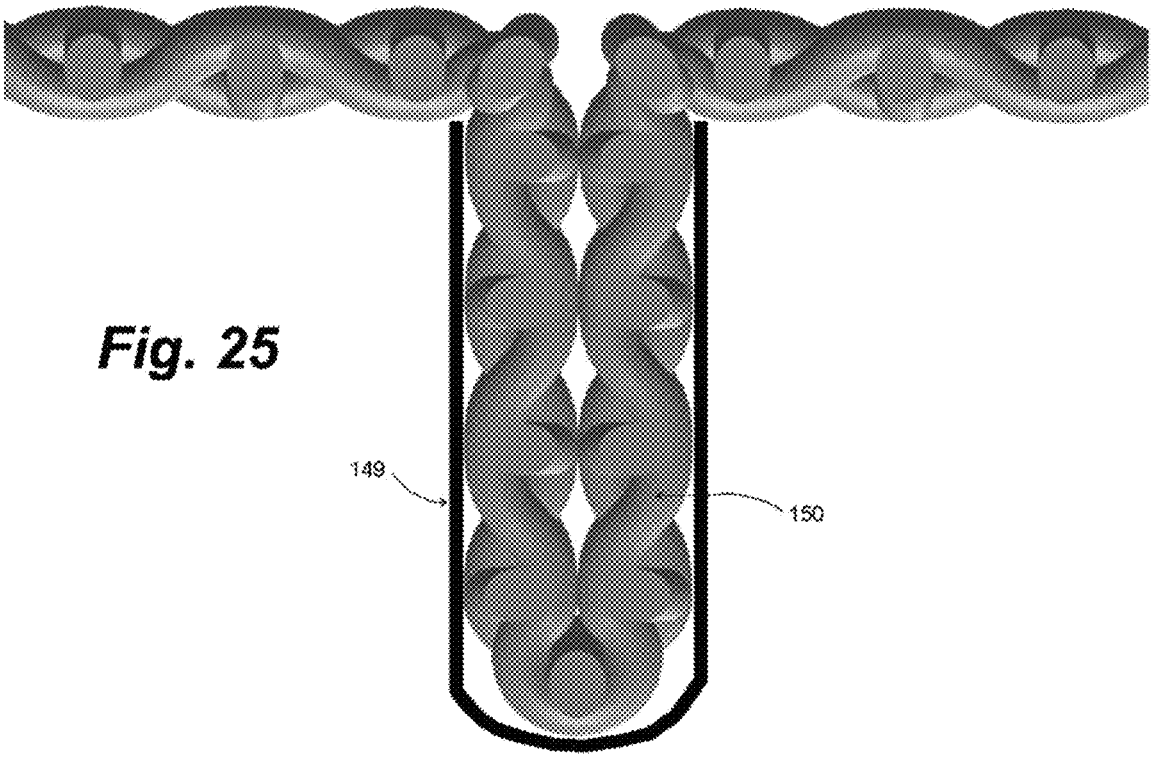
FIG. 25 illustrates an alternate embodiment of a double-girder.

FIG. 25 illustrates an alternate embodiment of a double-girder 150. In this embodiment, double-girder 150 includes a reinforcement cover 149. The use of a reinforcement cover 149 significantly increases the load capacity of the micromesh decking of the bridge portion. The reinforcement cover 149 is shown as U-shaped and can extend an entire longitudinal length of the double-girder 150, or partially, depending on design preference. The reinforcement cover 149 is operably configured to be disposed over the double-girder 150. It should be appreciated that the reinforcement cover 149 can be shaped similarly to the shape of the double-girder 150. The reinforcement cover 149 can be fastened to the outside of the double-girder 150. This cover is operably configured to envelope all or most of the area of the exposed double-girder 150. However, in some embodiments, it may only partially cover (in the vertical dimension) the double-girder 150. It will be appreciated that the cover can be fastened to the double-girder 150 by crimping, riveting, gluing or other similar fastening method, and so forth. It is preferred that the reinforcement member be made of stainless steel. It will be appreciated that other materials can also be utilized.

FIG. 26 shows an alternative embodiment of a double-girder 154 having a reduced depth 151. A reinforcement cover 152 can extend deeper 152 than the base 153 of the micromesh double-girder 154. With a shorter double-girder 154, this arrangement has the benefit of saving on the expense of using stainless steel micromesh or other materials for the double-girder 154 and leaving material for the decking.

FIG. 27 shows an alternative embodiment of a cover 155 having flanges 156 and 157. The cover 155 is U-shaped. The cover 155 can be fastened to the underside of the decking material 158 of the bridge portion, either over a double-girder (not shown) or without. In the latter case, the cover 155 is understood as proxying as a double-girder. That is, it can be used instead of a double-girder formed from the mesh decking, if so desired. The cover 155 is not formed from the decking material 158 of the bridge portion. This configuration eliminates the need for the decking material 158 to be used to form its own independent double-girder. It will be appreciated that the cover 155 can in other embodiments also form other hollow shapes when attached to the decking material 158 such as for example that of a triangle, square, rectangle, arched and so forth.

FIG. 28 shows an alternative embodiment of a cover 155*a*, that can be utilized independently as a girder. This cover 155*a* is solid and does not have a hollow center. This cover 155*a* has a vertical planar plate, formed as a solid girder, with two flanges 159 and 160. The flanges 159, 160 are disposed adjacent to the underside of the decking material 158 of the bridge portion. The cover 155*a* has the shape of a "T" because of the two flanges 159 and 160, however it can be made with a single flange (either one of flanges 159 or 160 would not be present).

FIG. 29 shows an alternative embodiment of a cover 155*b*, that can be utilized independently as a girder. This cover 155*b* can be in the shape of an I, as illustrated herein. The I shape is the traditional and common shape of a girder in bridges due to the increased support it provides to the overall structure. Cover 155*b* is similar to cover 155*a* of FIG. 28, however has additional flanges 161 and 162, which provide increased stability and structural integrity for supporting the upper micromesh decking and heavier loads of organic debris such as leaves, pine needs and branches.

Figure 30:
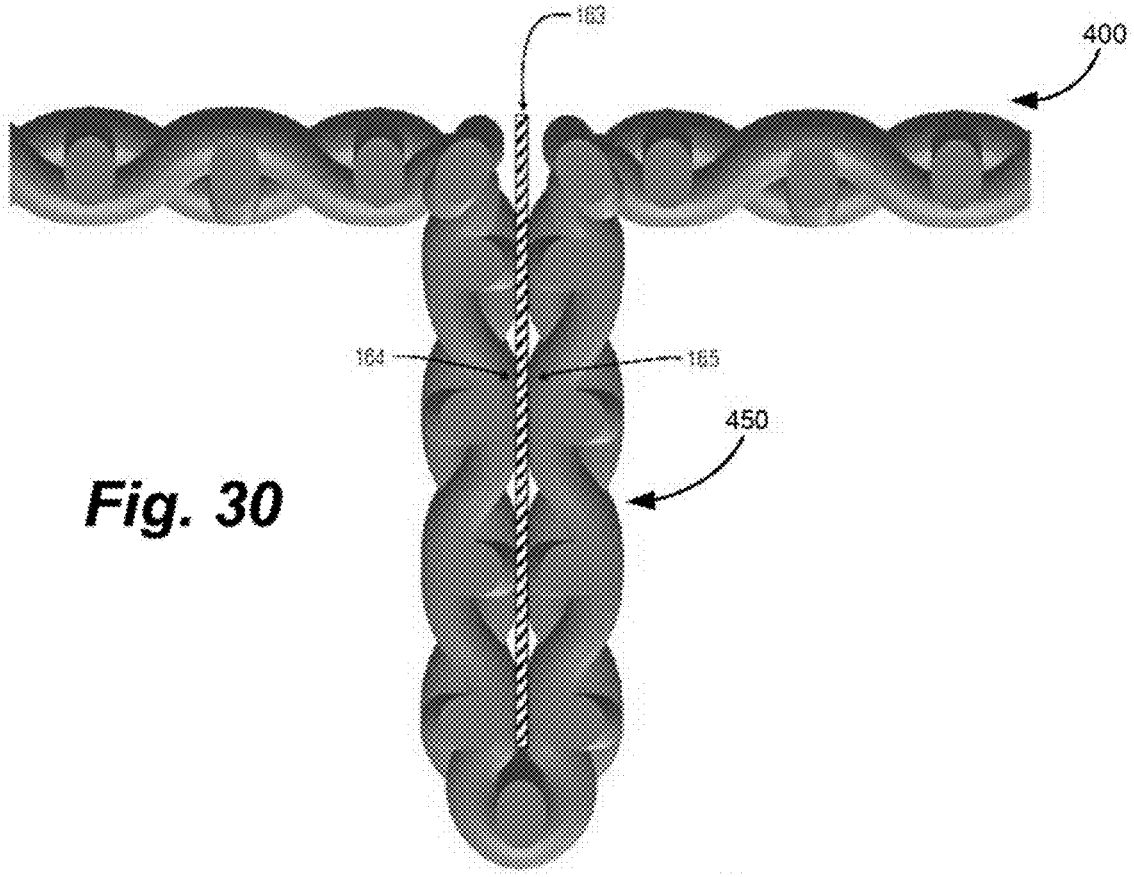
FIG. 30 shows an alternative embodiment of an exemplary double-girder with a reinforcement member.

FIG. 30 shows an alternative embodiment of an exemplary double-girder 400. This embodiment includes a girder 450 having a reinforcement member 163. The reinforcement member 163 can be thin sheet of rigid material. The reinforcement member 163 operates as a stiffener. The reinforcement member 163 (or stiffener) is disposed between the sides of the double-girder 450. In this scenario, both girder surfaces 164 and 165 are pressing firmly against the reinforcement member 163. The reinforcement member 163 provides additional support to the double-girder 450 by allowing it to bear greater dynamic loads on the deck surface of the bridge portion. It also gives the dual-girder 450 greater resistance against deformations from excessive loads. The stiffener 163 is locked in place during the assembly process when the mesh decking is inserted into the receiving centers of the longitudinal front and back floor beams and crimped closed, on the decking and double-girders 450. It is preferred that the reinforcement member be made from stainless steel. It will be appreciated that other materials can be utilized. Further, the reinforcement member can be attached to the girder with glue or their conventional fasteners.

Figure 31:
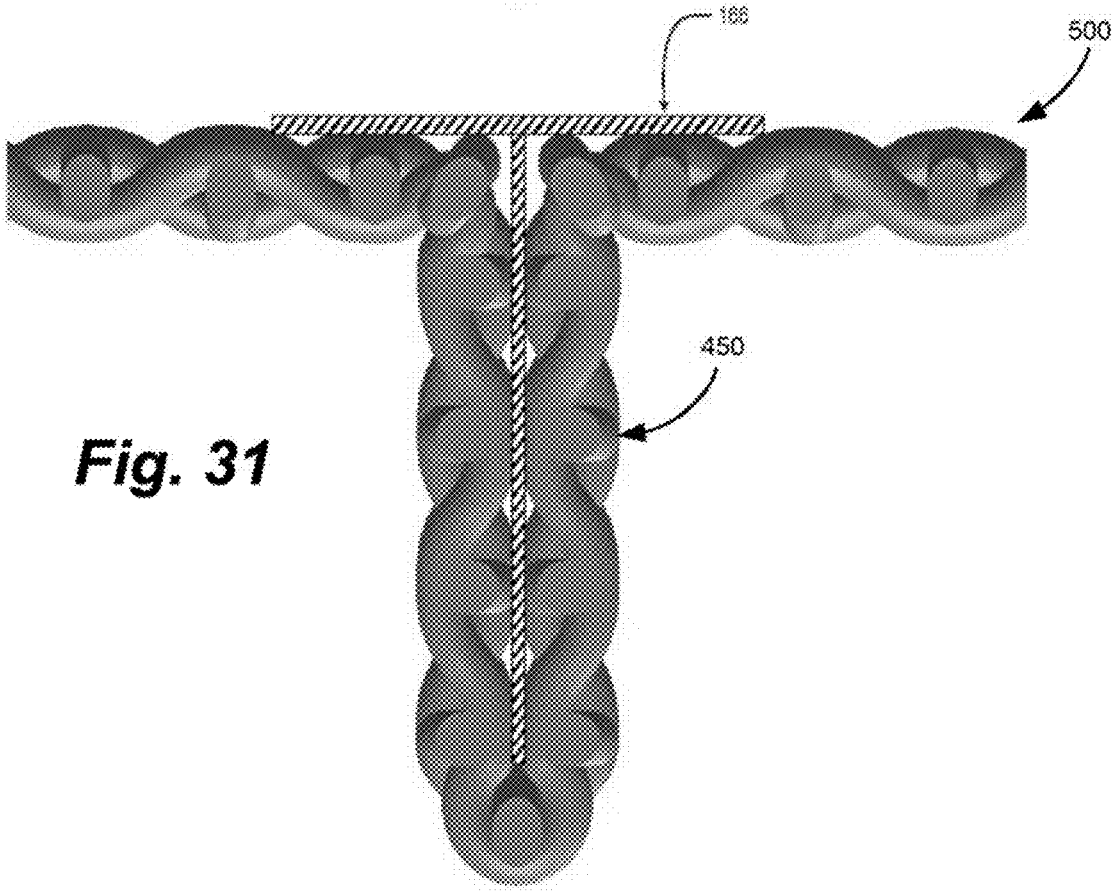
FIG. 31 shows an alternative embodiment of an exemplary double-girder with a top plate.

FIG. 31 shows an alternative embodiment of an exemplary double-girder 500, where the reinforcement member includes a top plate 166. The top plate increases the overall structural integrity of the double girder 450.

It will be appreciated that double-girders that include reinforcement members can span farther distances across a gutter with only minimal increases in depth of the girder as compared without a reinforcement member. Table D shows the ratios of sample girder-depth to length-with-reinforcement member ratios. The Table D shows acceptable specifications for these ratios. As each gutter increases in width by two inches, the "height" of the double-girder increases by 0.030 inches. The height is understood as the vertical dimension from the double-girder's bottom edge to the underside of the bridge. Also, it is understood that the following Tables refer to the double-girder as "girder."

TABLE D

Girder-Height To Length-With-Reinforcement Member (stiffener) Ratios

| Gutter Width: | Girder Length | Girder Height |
|---|---|---|
| 5 inches | 5 inches | 0.125 inches |
| 6 inches | 6 inches | 0.125 inches |
| 7 inches | 7 inches | 0.155 inches |
| 8 inches | 8 inches | 0.155 inches |
| 9 inches | 9 inches | 0.185 inches |
| 10 inches | 10 inches | 0.185 inches |
| 11 inches | 11 inches | 0.215 inches |
| 12 inches | 12 inches | 0.215 inches |

Figure 32:
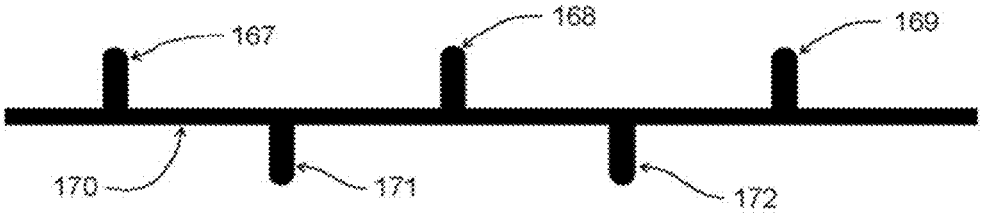
FIG. 32 displays an alternative embodiment of an exemplary gutter guard device with a plurality of opposing side girders.

FIG. 32 displays a portion of a rear profile view of an alternative embodiment of an exemplary gutter guard device with a plurality of girders 167, 168, 169, 171, and 172, some of which are disposed on opposing surfaces of the decking of the bridge portion 170. Girders 167, 168 and 169 formed on the top side of the decking of the bridge portion 170, whereas girders 171 and 172 are formed on the opposing bottom side. The girders in this embodiment are equally spaced apart from each another. It should be understood that the top side girders can be interpreted, by some as "trusses," however, for the purposes of this application and for simplicity sake, they all shall be referred to as girders, regardless of whether they are top side located or not.

Figure 33:
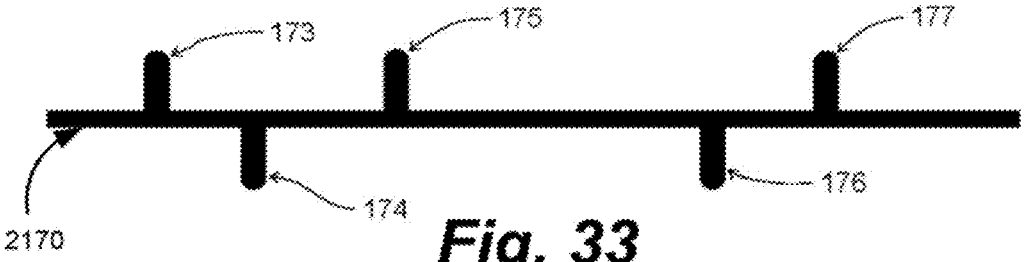
FIG. 33 display another embodiment of an exemplary gutter guard device with a plurality of irregularly spaced girders.

FIG. 33 illustrates another embodiment of an exemplary gutter guard device with a plurality of girders 173-177, wherein the girders are irregularly spaced apart from another. Girder 173, 175 and 175 are irregularly disposed on the top surface of the bridge portion 2170 and the girders 174 and 176 are disposed on the bottom.

Figure 34:
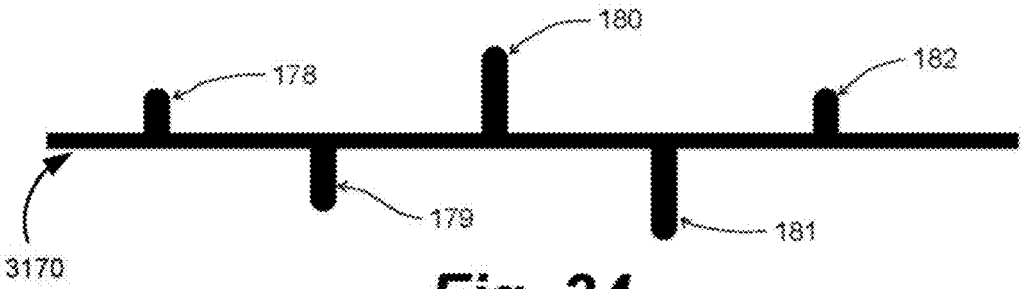
FIG. 34 illustrates another embodiment of an exemplary gutter guard device with girders of varying depths and heights.

FIG. 34 illustrates another alternative embodiment of an exemplary gutter guard device with girders 178, 179, 180, 181 and 182 formed with varying depths and heights on opposing sides of the bridge portion 3170.

Figure 35:
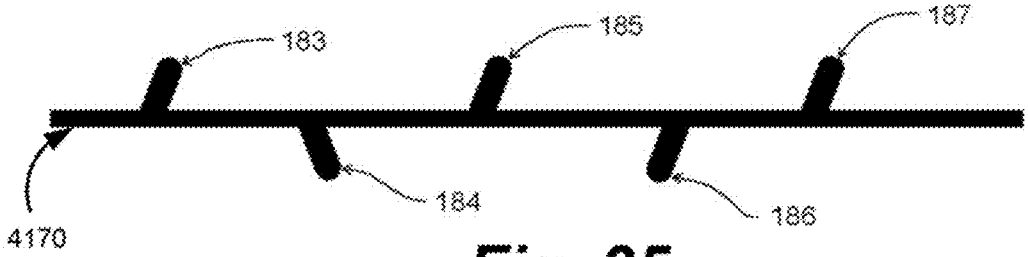
FIG. 35 illustrates another embodiment of an exemplary gutter guard device with angled girders.

FIG. 35 illustrates another alternative embodiment of an exemplary gutter guard device with girders 183, 184, 185, 186 and 187 disposed at an angle (slanted) on the bridge portion 4170. Particularly, these girders are disposed non-perpendicular relative to the respective surface of the bridge portion 4170.

The above Figs. illustrate various possible combinations of shapes, orientations, heights, locations, etc. for girders about their respective bridge portion. Further, the girders shown in FIG. 31 and thereafter are understood to also be capable of being of the mesh-form (double-girder). Accordingly, for purposes of simplicity, the term girder will be used as the generic expression to describe either a single structure girder or a double/multiple-structure (mesh-formed) girder, unless it is expressly stated otherwise or the context inherently prohibits the alternative structure. In view of the above, it is understood that the above features may be altered or combined to form different embodiments by one of ordinary skill without departing from the spirit and scope of this disclosure.

Figure 36:
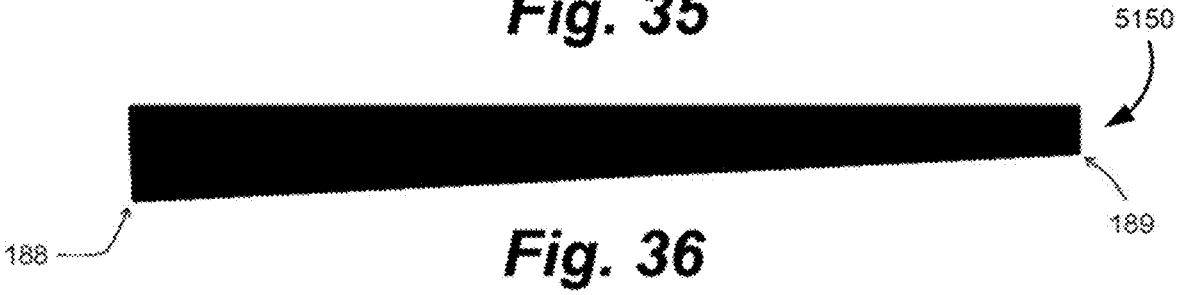
FIG. 36 shows a side view of an embodiment of an exemplary girder with differing terminating heights.

FIG. 36 shows a side view of an embodiment of an exemplary girder 5150 with differing terminating heights. For example, a bottom chord of the girder 5150 is deeper on one side 188 than the opposite side 189. It will be appreciated that the bottom chord depth differences in other embodiments, can also be irregular in depth from other girders, if so desired.

Figure 37:
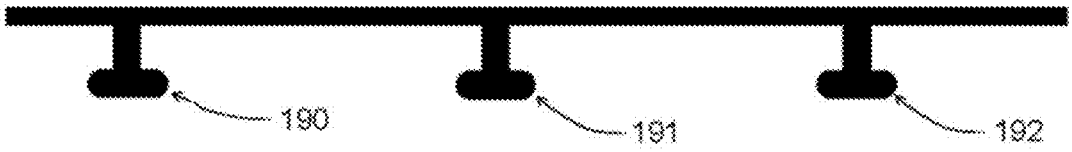
FIG. 37 shows an exemplary embodiment with girders having an inverted "T" profile.
Figure 38:
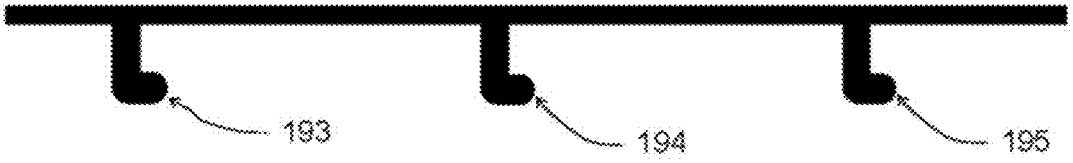
FIG. 38 shows an exemplary embodiment with girders having an "L" profile.
Figure 39:
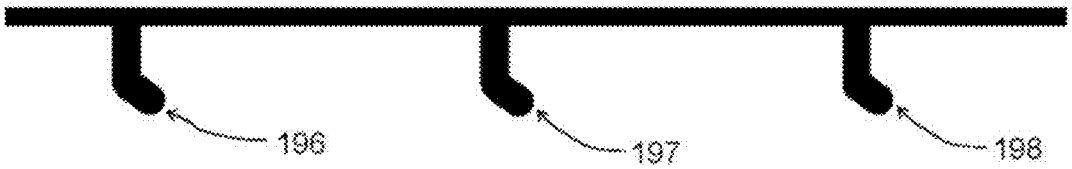
FIG. 39 shows an exemplary embodiment with girders with different portions slanting differently.
Figure 40:
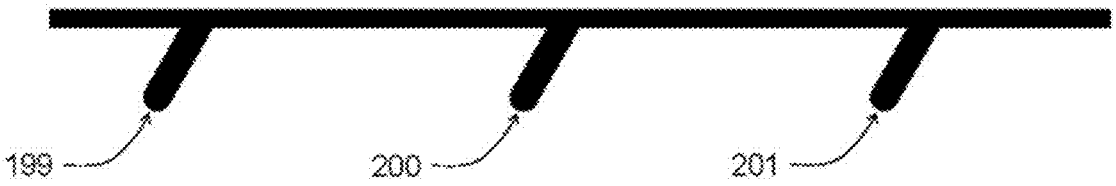
FIG. 40 shows an exemplary embodiment with slanted girders.

FIGS. 37, 38, 39 and 40 illustrate rear profiles of alternative embodiments of exemplary girders. For example, FIG. 37 shows girders 190, 191 and 192 having a rear profile shape of an inverted "T." Whereas in FIG. 38, girders 193, 194 and 195 have a rear profile shape of an "L." FIG. 39 illustrates how only a portion of the lower base of girders 196, 197 and 198 are slanted relative to the upper portion of the girders. FIG. 40 shows girders 199, 200 and 201, being attached to the decking at a slanted angle.

In view of the above, it will be appreciated that variations and combinations of the girder shapes, angles, heights, etc. can be made, so as to have, for example, a variety of contour shapes along their lateral length from the front to back of the gutter guard device other than being perpendicular, somewhat perpendicular or angled.

Figure 41:
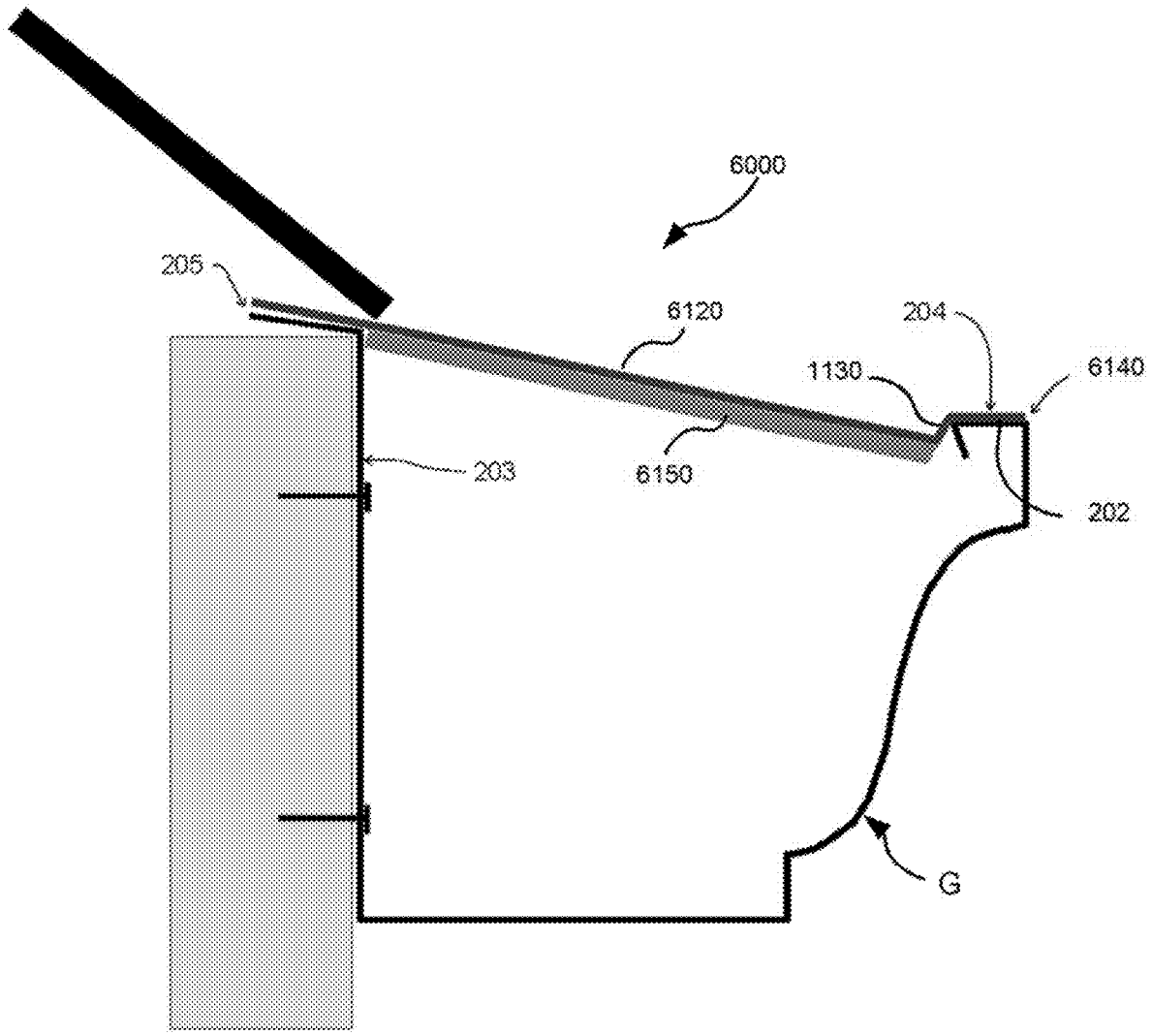
FIG. 41 shows the side view of an alternative embodiment of an exemplary device over a gutter.

FIG. 41 shows the side view of an alternative embodiment of an exemplary device 6000 in use over a gutter G. In this embodiment, the device 6000 includes a trough portion 1130 disposed between the bridge portion and the gutter attachment portion 6140. To assist with creating a strong anchor of the device 6000 to the gutter G, the front lip of the gutter 202 and back of gutter 203 are acting as abutments for supporting the device 600, similar to the spanned ends of a conventional bridge. The device 6000 can be fastened to the top 204 of the front lip of the gutter 202 by snapping in place, screwed in with screws, adhered to with double sided adhesive tape or other fastening mechanism. The back of the device 600 can rest or be screwed into either the back of the gutter 203, fascia or plywood sheeting of the roof 205.

FIGS. 42-54 illustrate alternative embodiments of exemplary bridge portions. Particularly, these embodiments have a decking of the bridge portion that includes at least one or more barricade(s). Barricades are localized deformations or shape changes disposed within the bridge portion and, in of themselves, do not provide self-supporting capabilities to the bridge portion. A barricade is essentially a water barricade disposed in the decking between girders. The barricades can be recessed or bumped areas in the decking material, whether the decking be a mesh material, a perforated sheet material, or anything else. Because rainwater, after penetrating through the decking material, typically adheres to the underside of decking while traveling down the device, various shaped obstacles, such as the barricades, formed into the material decking will assist in redirecting the water to drop into the gutter. The early release of water from the decking into the gutter allows non-penetrating water traveling or resting on the top of the decking to now penetrate more easily. This feature operates to increase the drainage rate for a given decking area. Note girders are not shown in FIGS. 42 and 43.

Figure 42:
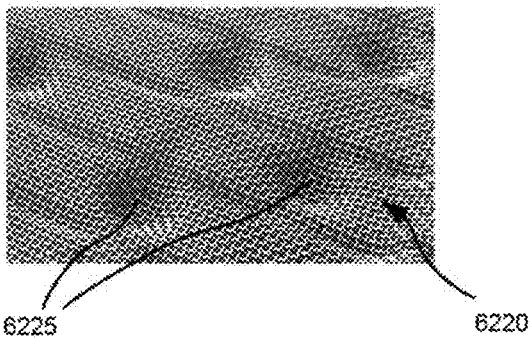
FIG. 42 is an illustration of a recessed barricade in a micromesh decking.
Figure 43:
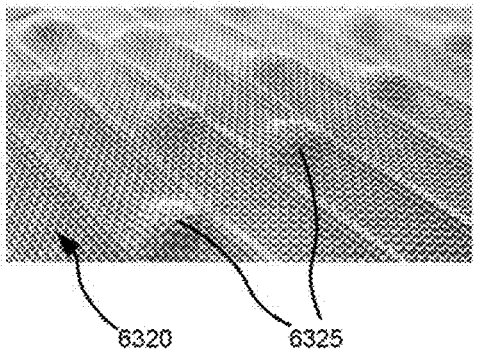
FIG. 43 illustrates a bumped barricade in a micromesh decking.

FIG. 42 is an illustration of a recessed barricade 6225 in a micromesh decking 6220. The barricade 6225 is considered recessed because it is formed in the mesh 6220 such that the barricade 6225 extends down from the plane of the decking. FIG. 43 illustrates a bumped barricade 6325 in a micromesh decking 6320. The barricade 6325 is considered bumped because it is formed in the mesh 6320 such that the barricade 6325 extends up from the plane of the decking. The barricades 6225, 6325 apply tension on the plane of the woven wires of the micromesh 6220, 6320, respectively. This tension tightens and strengthens the mesh making it more rigid, sturdy, less prone to sagging and able to withstand heavier loads. It will be appreciated that the barricades can take a variety of shapes and designs, whether it is on a mesh or perforated. sheet type material. The shapes of the barricades can be of a plethora of designs and disposed in any order. The barricades can be mixed together with other designed shapes, positioned in any location, positioned in any direction and at any angle between the girders. It will be appreciated that although the barricades shown are formed in a micro-mesh decking, the barricades according to the present invention can also be disposed in a non-mesh decking material such as, but not limited to, a sheet of perforated aluminum.

It will be appreciated that the barricade can be a separate material affixed to the bridge portion or it could be an impression formed directly in the material of the bridge portion.

It will be appreciated that having a recessed barricade on the bottom surface protruding into the gutter opening when in use, will aide in diverting rainwater into the gutter. Further, having barricades with orifices (larger that the mesh orifice) will further accelerate water penetration. It will be appreciated that having a barricade-like structure on the top surface protruding away from the gutter opening when in use, will aide in preventing debris from not collecting on the bridge portion. Particularly, leaves can often be wet and when wet will not readily move off. Having the barricade-like structure will allow a leaf, or the like to span from the top surface of the bridge portion to the barricade-like structure. In this arrangement, the leaf will tend to dry out quicker. Being drier will allow the wind to blow the leave off the gutter. Further, with a gap below the leaf, wind can pass below the leaf, enabling faster drying of the leaf. Still further, the gap allows wind to travel below the leaf and this increases the likelihood the leaf will be blown off of the device.

Figure 44:
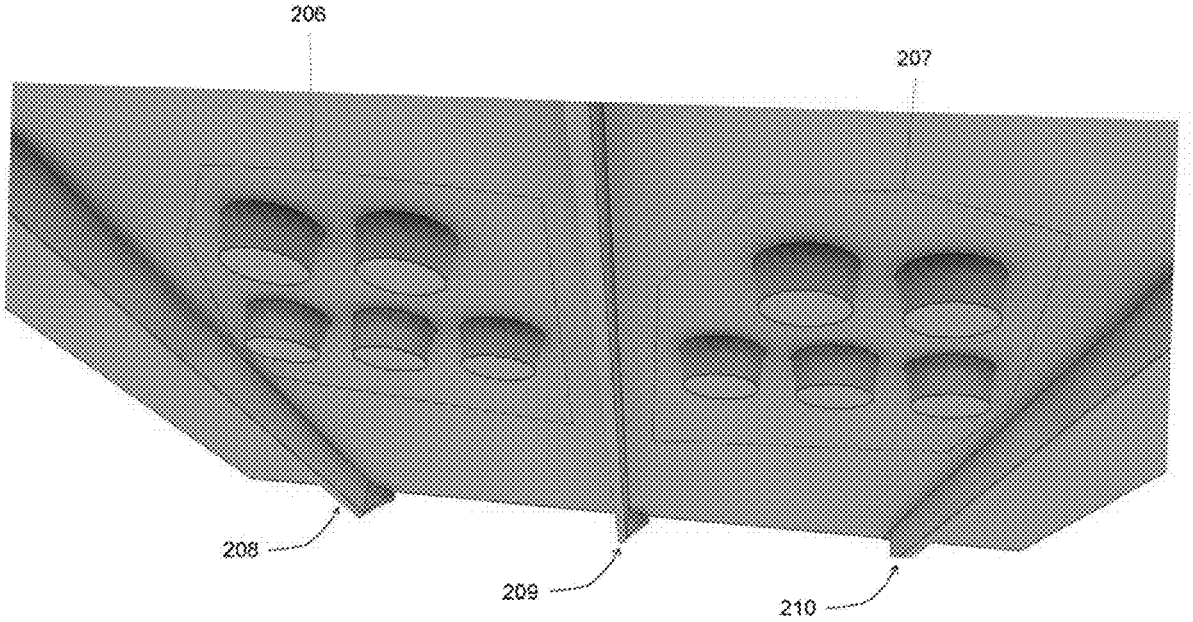
FIG. 44 illustrates an alternative embodiment of a barricade structure that is circular and grouped together.

FIG. 44 illustrates a bottom perspective view of an alternative embodiment of a barricade structure, wherein recessed or bumped decking material can be used from the bridge portion. The barricades in this embodiment are shown with a circular shape and grouped together in clusters, for example clusters 206 and 207, which are clusters of five barricades. The barricades are disposed on the bridge portion between girders 208, 209 and 210. More or less than five barricades can be in a given cluster. The circular shapes of the barricades can be very small in diameter and as large as the span between the girders. It will be appreciated that one or more of the recessed or indented barricades can be of any shape including oval, regular or irregular quadrilaterals, regular or irregular polygons, concave or convex contours or a mix of several shapes.

Figure 45:
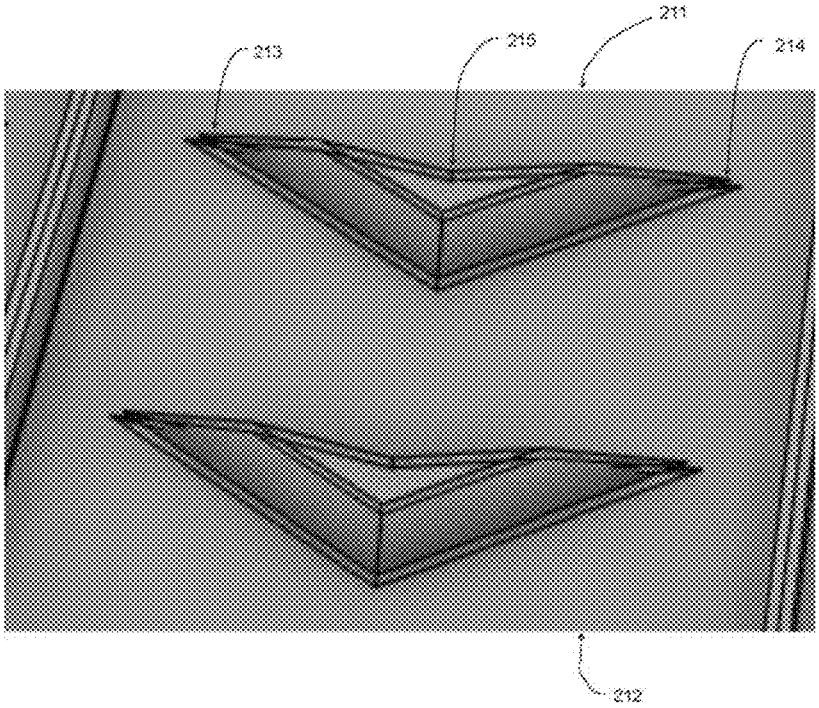
FIG. 45 illustrates an alternative embodiment of a bridge portion having arrow head shaped barricades.

FIG. 45 illustrates of bottom perspective view of an alternative embodiment of a bridge portion having at least one arrow shaped barricade. In this embodiment, there are two recessed barricades. For purposes of clarity, barricade orifices and bridge portion orifices are not shown. It will be appreciated that in other embodiments, the barricades could be bumped. With this recessed, rainwater traveling down from the roof towards the back 211 of the decking to the front 212 of the decking will be trapped and channeled by the outer edges 213 and 214 of the arrow to the center of the arrow 215 and drop into the gutter. The increased efficacy of rainwater dropping into the gutter will occur with the barricade in the decking. It will be appreciated that more barricades in a given space will increase the rate of rainwater dropping into the gutter.

Figure 46:
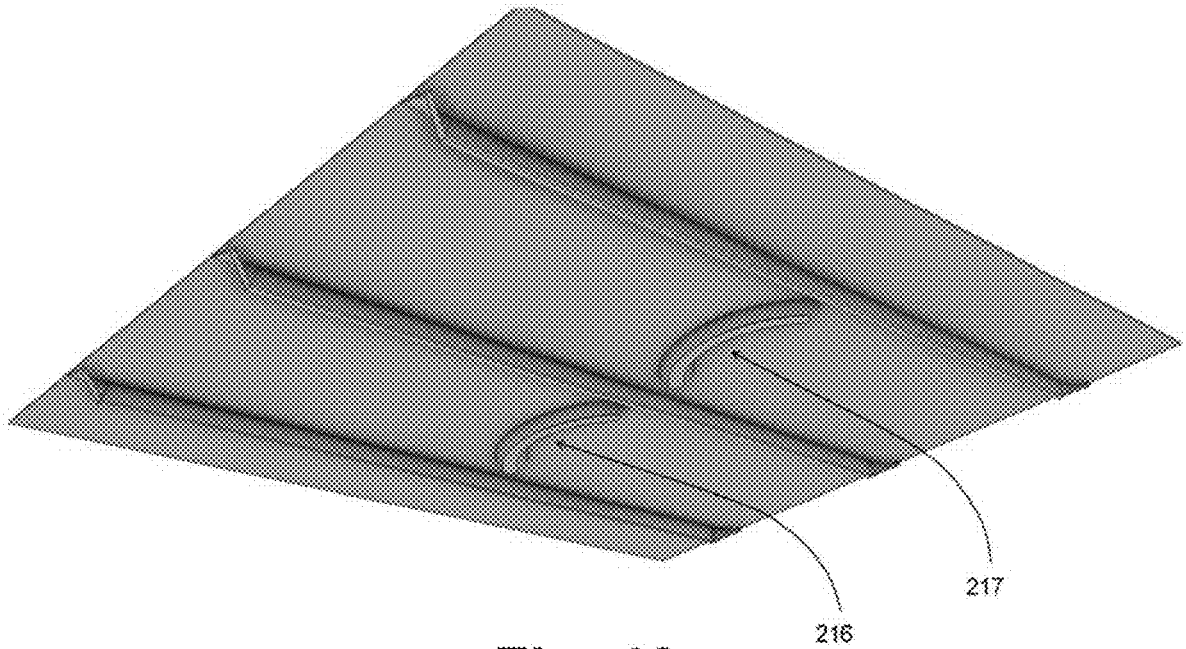
FIG. 46 shows barricades having a crescent shape.
Figure 47:
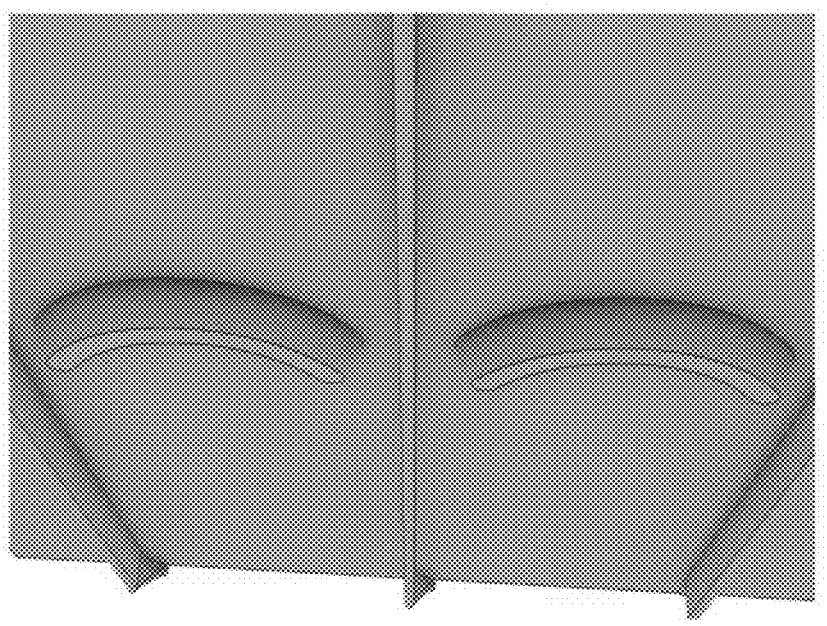
FIG. 47 illustrates a closer view of FIG. 46's embodiment.
Figure 48:
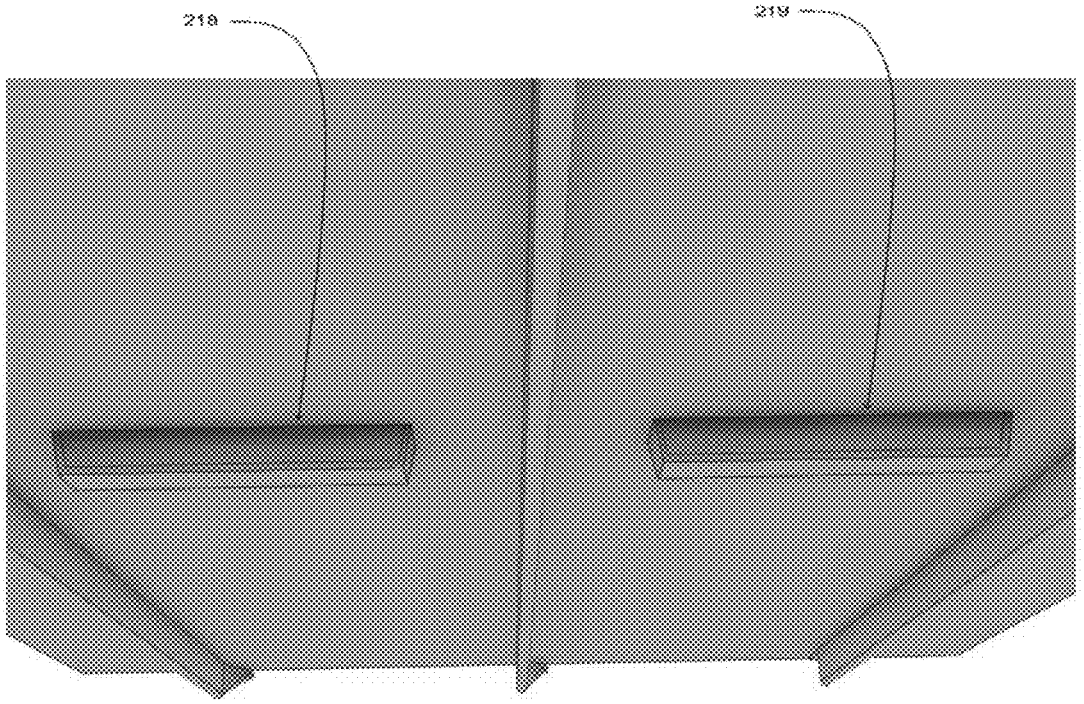
FIG. 48 shows recessed rectangular shaped barricades.
Figure 49:
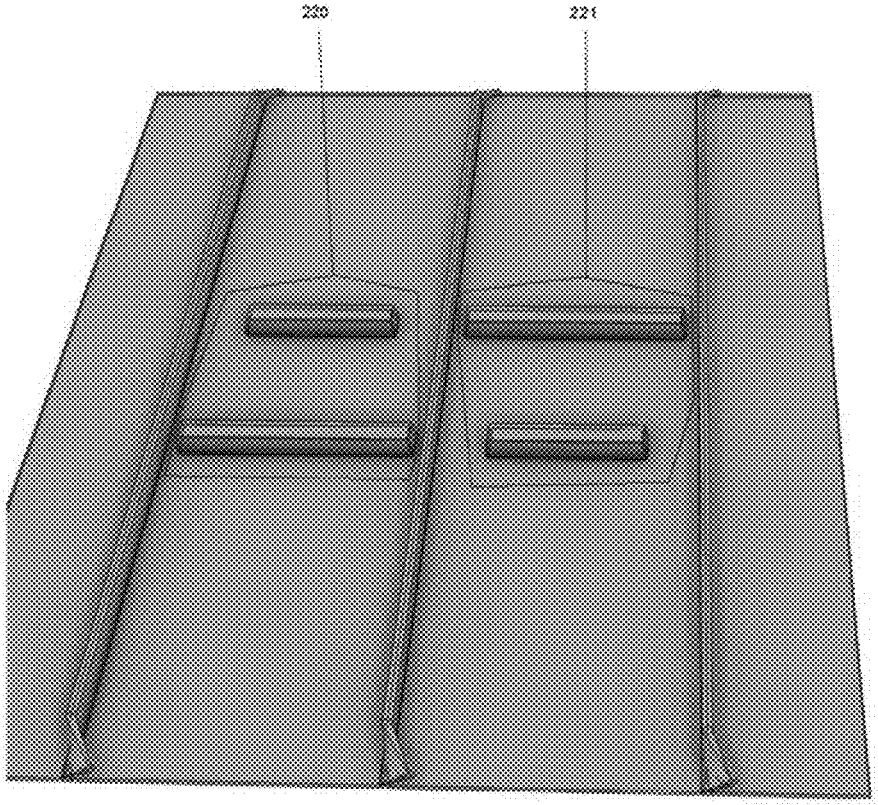
FIG. 49 shows recessed irregular dimensioned and spaced rectangular shaped barricade.
Figure 50:
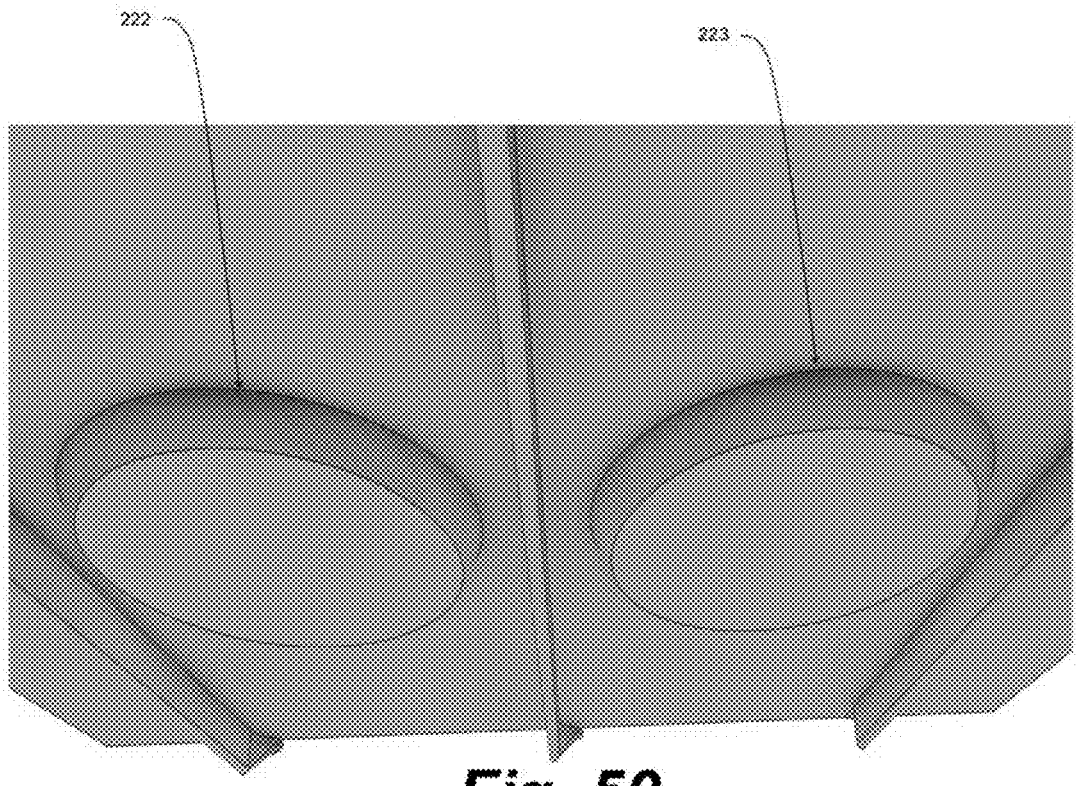
FIG. 50 shows oval shaped barricades that span close to the edges of adjacent girders.

FIGS. 46-54 illustrate bottom perspective views of alternative examples of shapes for recessed barricades. Particularly, FIG. 46 shows barricades 216 and 217 having a crescent shape. It will be appreciated that the crescent shaped barricades can be disposed at any desired angle with respect to the girders. FIG. 47 illustrates a closer view of the crescent shapes. FIG. 48 shows recessed rectangular shaped barricades 218 and 219. FIG. 49 shows recessed irregular dimensioned and spaced rectangular shaped barricades 220 and 221. It will be appreciated that the barricades can have concave or convex sides. FIG. 50 shows oval shaped barricades 222 and 223 that span close to the edges of adjacent girders. Orifices in recessed barricades and bridge portion are not shown for clarity purposes. It will be appreciated that the barricades shown could in other embodiments be disposed such that they are bumped up from the bridge portion.

Figure 51:
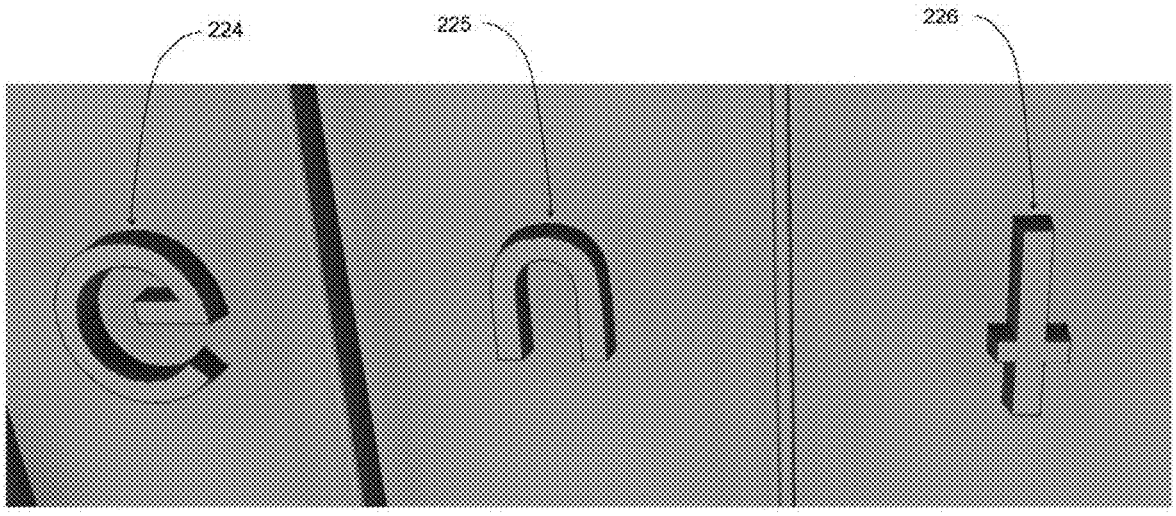
FIG. 51 shows letter-shaped barricades.
Figure 52:
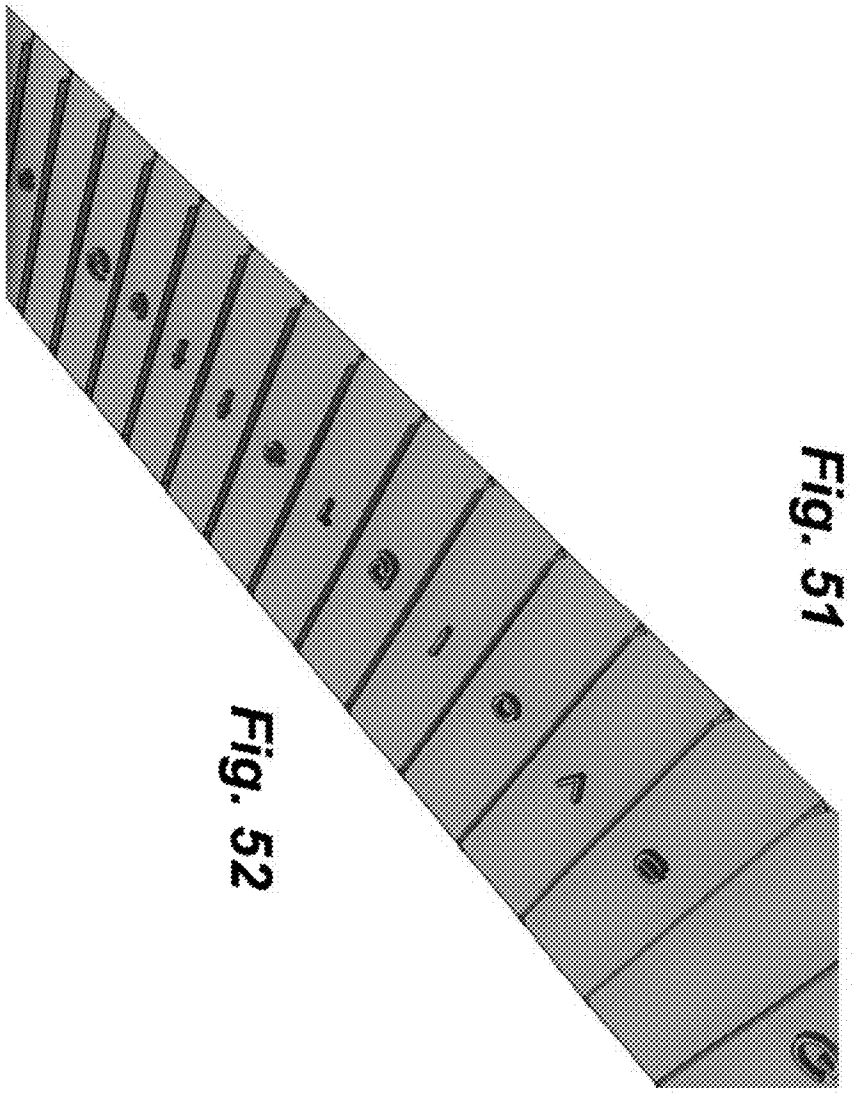
FIG. 52 is a wider view of FIG. 51.
Figure 53:
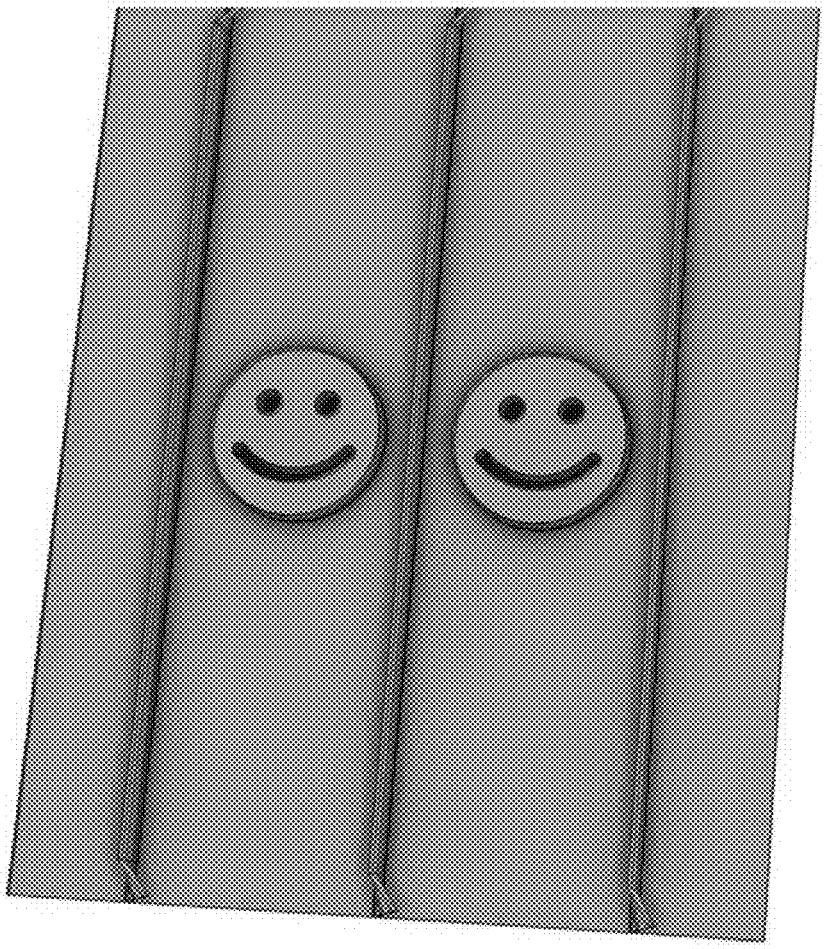
FIG. 53 shows a smiley faced barricade.
Figure 54:
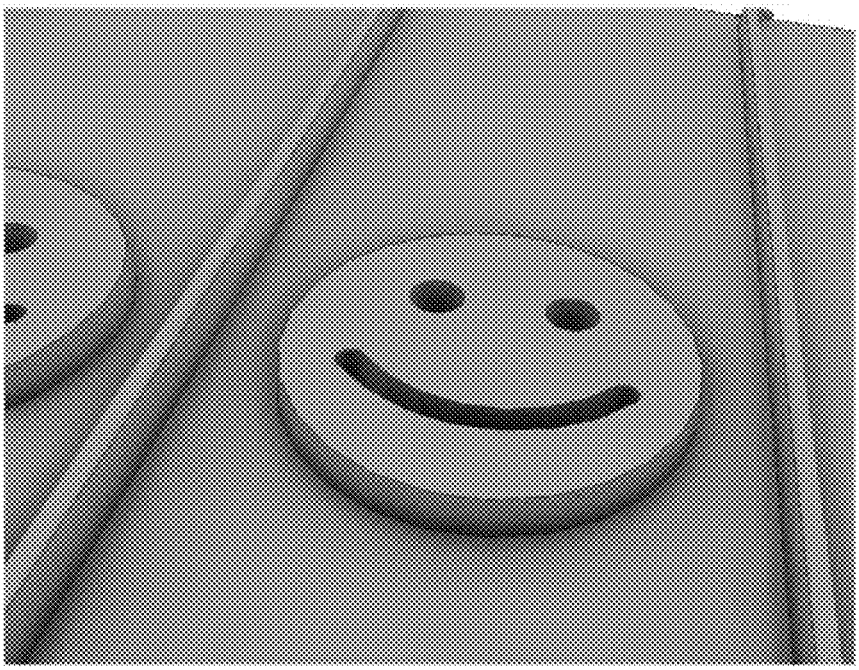
FIG. 54 is a closer view of FIG. 53.

Shaped designs of barricades can also make the decking of the device more aesthetic. FIG. 51 shows letter-shaped barricades 224, 225 and 226. Letter shaped barricades can be formed into brand names or other information and stamped in this area providing immediate identification of the product and/or manufacturer, for example. FIG. 52 is a wider view of FIG. 51, showing more letter shaped barricades. FIG. 53 shows an example that the decking can also have one or more of many designs for the barricade, such as fanciful images as an emoji-like image. A smiley faced barricade is shown in this figure. FIG. 54 is a closer view of FIG. 53.

It will be appreciated that in other various exemplary embodiments, recessed barricades and bumped barricades can be combined on the same device.

Figure 55:
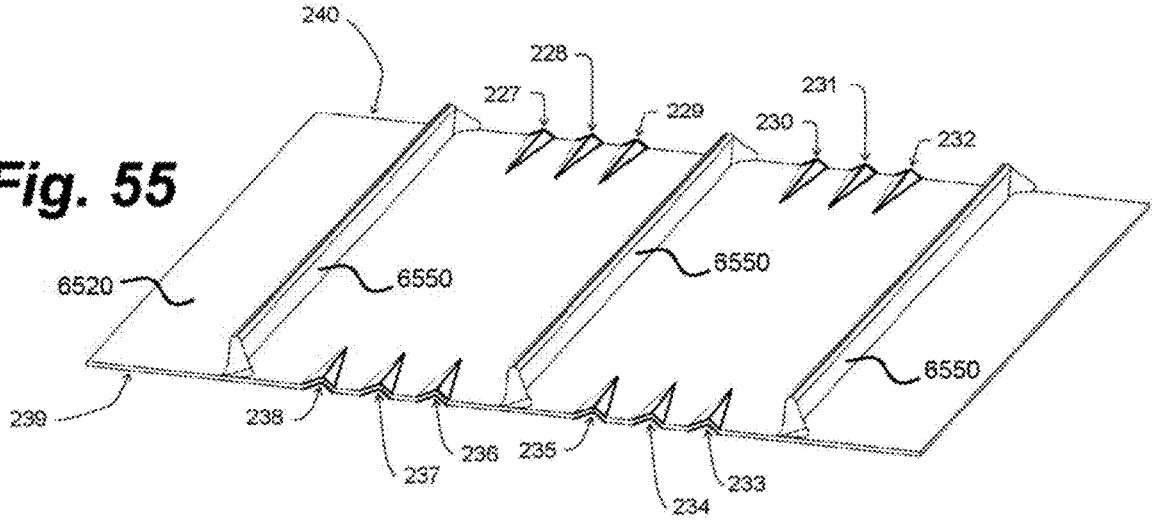
FIG. 55 illustrates an alternative embodiment of an exemplary device with a crease.
Figure 56:
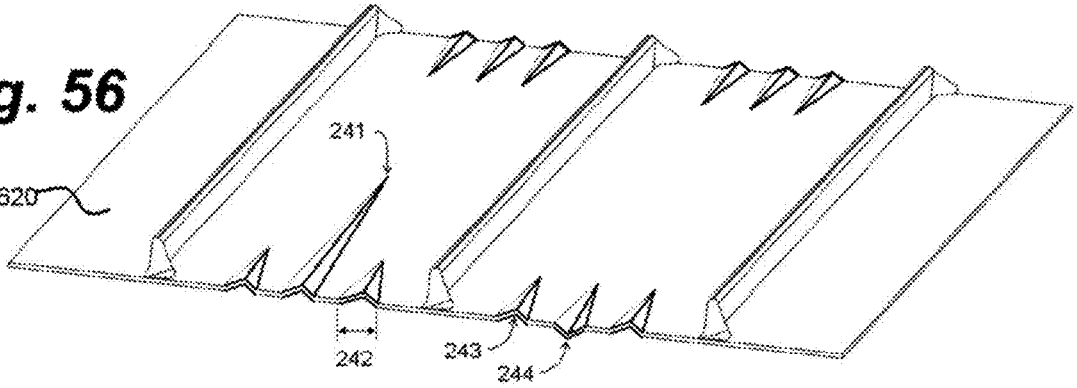
FIG. 56 illustrates another alternative embodiment of an exemplary device with a crease.

FIGS. 55 and 56 illustrates bottom views of alternative embodiments of an exemplary device, shown without front and rear beams. For purposes of clarity, orifices in the device are not shown. In FIG. 56, A bridge portion 6520 of this embodiment includes at least one crease. In this embodiment, the bridge portion 6520 includes a decking having creases 227, 228, 229, 230, 231, 232, 233, 234, 235, 236, 237 and 238. Some of the creases are disposed along a longitudinal front edge 239 and some along a back edge 240 of the decking. This arrangement will allow receiving centers of floor beams (the gutter attachment and roof attachment portions), not shown, to be more able to fasten to the bridge portion 6520. Additionally, the creases create a more aesthetic appearance. It is preferred that the creases have a length equal to or greater than about the width of the receiving centers of the floor beams. Further, the creases, or wrinkles, can have lengths, which extend well beyond the width of the floor beams and further into the micromesh decking. With such a length, the creases would benefit the device by providing additional crease-derived strength in tandem with the girders' 6650 support. It will be appreciated that the creases do not have to begin at the edge of the longitudinal front 239 or 240, they can begin at the exposed front and back floor beams. In this configuration, the creases would be adjacent to the floor beams but not inside the floor beams (not shown). It is noted that one or more of the creases can be "reversed" so as to bumped up, if so desired.

It will be appreciated that as shown in FIG. 56, that the creases can have varying lengths 241, varying widths 242 and be formed upwards 243 in the decking or downwards 244 in the decking. The starting shape of the crease can be that of variety of shapes, such as but not limited to a half hexagon, triangle, box, sinusoidal, off center, dip or other shape. The shapes of the creases then transition into the planar surface of the mesh decking of the bridge portion 6620.

Figure 57:
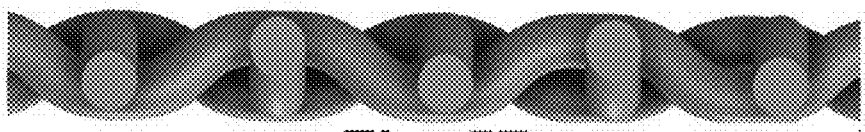
FIG. 57 shows the plane woven micromesh material prior to being stretched.
Figure 58:
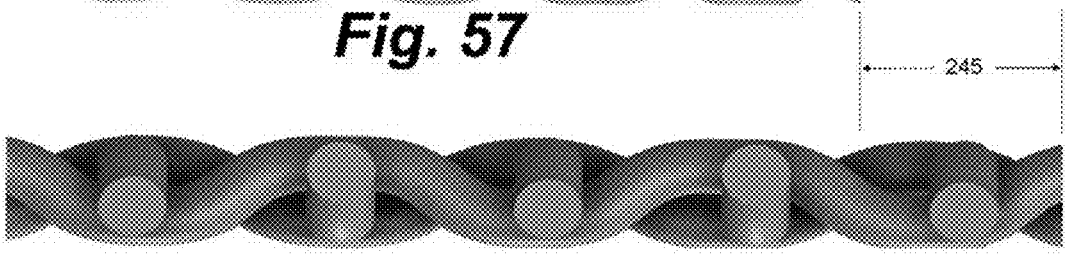
FIG. 58 shows the plane woven micromesh material after being stretched.

FIG. 57 shows a plane woven micromesh material prior to being stretched through the forming process as illustrated in and described with FIG. 9. FIG. 58 shows the same section of micromesh in FIG. 57, but after it is stretched 245. The tensioning process during manufacturing creates a stiffness in the micromesh and slightly increases the length. Tensioned wires are less likely to be compromised under increased loads on the micromesh decking because the woven wires are no longer pre-disposed to flexing due to loads exerted on the decking material. Stretched or tensioned woven wires reduces the flexible droopiness and sagging that can exist in the micromesh decking. Tensioned micromesh dual-girder allows for a more rigid vertical and horizontal cross wires.

Figure 59:
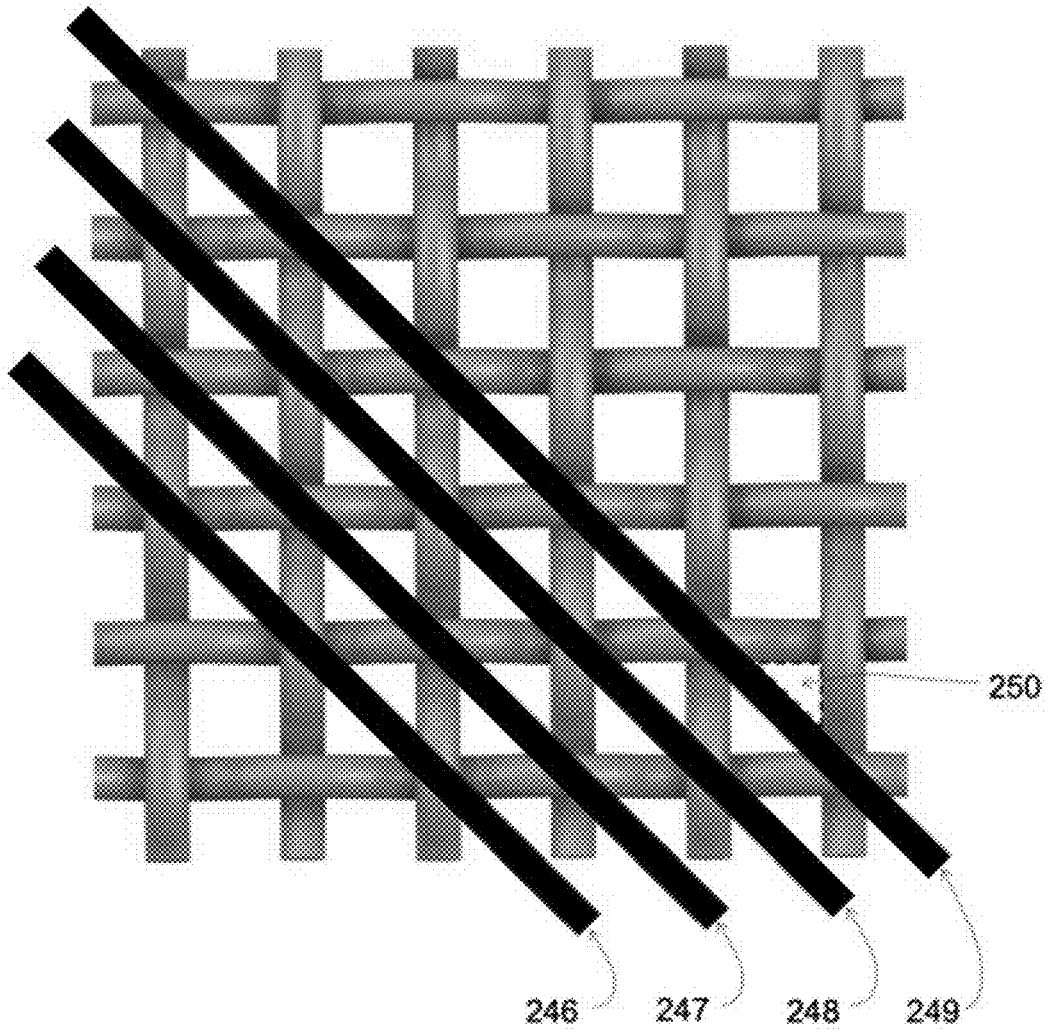
FIG. 59 shows an interwoven micromesh.

FIG. 59 shows an interwoven micromesh. As opposed to the traditional woven micromesh material where all spacing between the wires consist of quadrilateral squares or rectangles, diagonally woven-in wires 246, 247, 248 and 249 to these equilateral squares to form isosceles triangle units 250. This arrangement will provide the exemplary double-girders with a triangular shaped web configuration providing additional load bearing attributes as in a traditional latticed bridge. In various embodiments, the above interwoven mesh type can be used in the decking of the bridge portion as well as for the double girders, barricades and other desired structures. It is preferred that the woven-in wires be made of stainless steel. However, it will be appreciated that other materials can be utilized.

Figure 60:
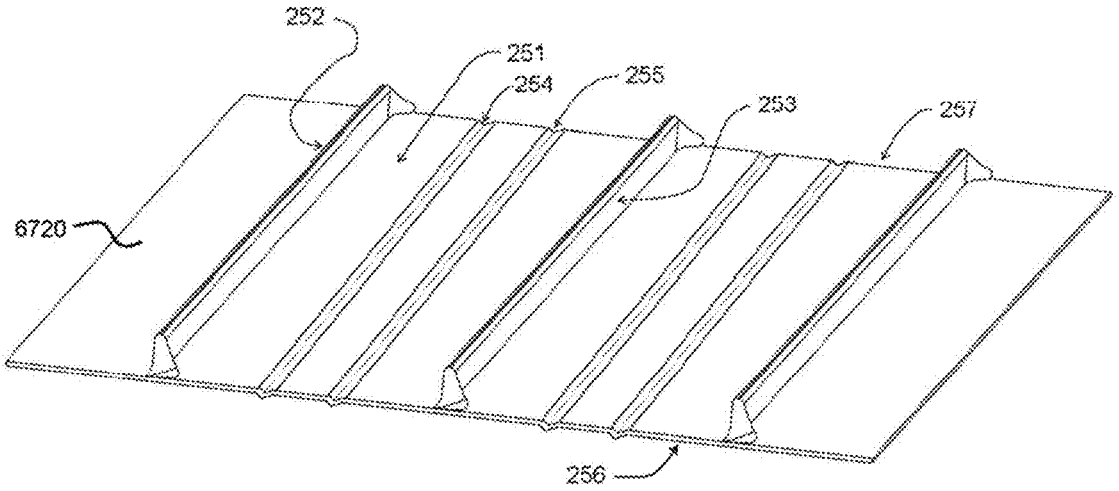
FIG. 60 shows an alternate embodiment of the decking material with at least one groove.
Figure 61:
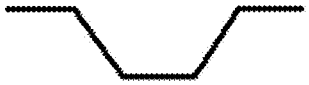
FIG. 61 displays a side profile view of an exemplary half hexagon-shaped groove.
Figure 62:
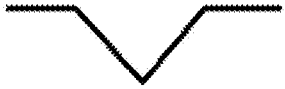
FIG. 62 displays a side profile view of an exemplary triangular-shaped groove.
Figure 63:
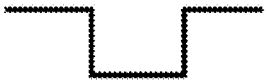
FIG. 63 displays a side profile view of an exemplary box-shaped groove.
Figure 64:
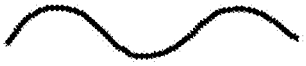
FIG. 64 displays a side profile view of an exemplary sinusoidal-shaped groove.
Figure 65:
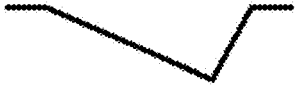
FIG. 65 displays a side profile view of an exemplary off center-shaped groove.
Figure 66:
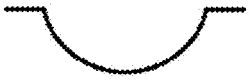
FIG. 66 displays a side profile view of an exemplary dip-shaped groove.

FIG. 60 shows is a bottom view of an alternate embodiment of exemplary device, wherein open areas of the decking material 251 includes at least one groove. The orifices in the bridge portion and the front and rear beams are not shown for clarity. In this embodiment, the at least one groove is a plurality of grooves 254 and 255, and are shown here as disposed between girders 252 and 253. The grooves 254, 255 are disposed in the planar surface of the bridge portion 6720. The grooves 254, 255 provide additional support to the device. While the term groove suggests a valley-like or recessed channel-like feature, it is understood that it may also apply to the reverse (or flipped) shape having a ridge-like or elevated channel-like feature. The applicable interpretation being evident in the context being described.

In various embodiments, the grooves 254, 255 are be disposed across the entire front-back span of the bridge portion 6720 or in other embodiments, the grooves extend only a portion thereof. Further, grooves adjacent to each other are be parallel. However, it will be appreciated that adjacent grooves in other embodiments, can be non-parallel to other adjacent grooves. As shown here, the grooves 254, 255 are perpendicular to the front 256 and the back 257 of the bridge portion 6720. However, non-perpendicular and/or non-linear grooving may be utilized, if so desired.

FIGS. 61, 62, 63, 64, 65, and 66 display side profile views of various examples of alternative profile shapes for exemplary grooves, namely, half hexagon, triangular, box, sinusoidal, off center, and dip, respectively. It will be appreciated, that other shapes may be utilized in, yet other embodiments and these shapes are only some of the examples. It will be appreciated that the shapes can be inverted as well.

Figure 67:
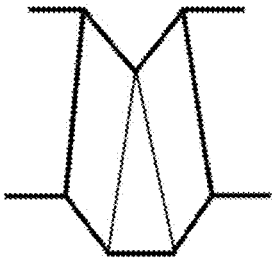
FIG. 67 displays a side profile view an exemplary half hexagon to a triangle profile groove.
Figure 68:
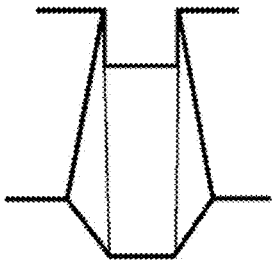
FIG. 68 shows an exemplary half hexagon to a box profile groove.
Figure 69:
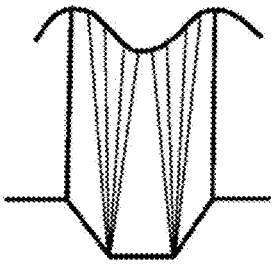
FIG. 69 shows an exemplary half hexagon to sinusoidal profile groove.
Figure 70:
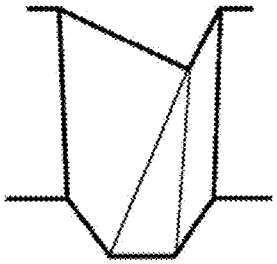
FIG. 70 shows an exemplary half hexagon to an off center profile groove.
Figure 71:
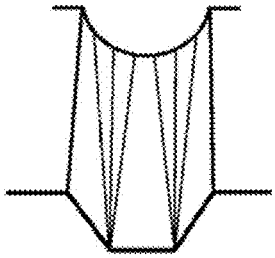
FIG. 71 shows an exemplary half hexagon to a dip profile groove.

FIGS. 67, 68, 69, 70 and 71 display front perspective views of alternative profile shapes for the exemplary grooves. Particularly, these profiles change their geometry along the length of the groove. FIG. 67 shows a groove profile shape transition along its length from a half hexagon profile to a triangle profile. FIG. 68 shows a groove profile shape transition along its length from a half hexagon profile to a box profile. FIG. 69 shows a groove profile shape transition along its length from a half hexagon profile to a sinusoidal profile. FIG. 70 shows a groove profile shape transition along its length from a half hexagon profile to an off center profile. FIG. 71 shows a groove profile shape transition along its length from a half hexagon profile to a dip profile.

Figure 72:
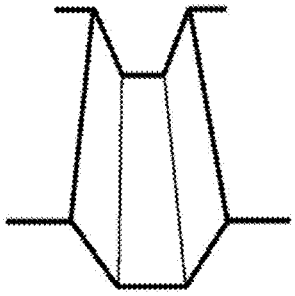
FIG. 72 shows an exemplary half hexagon profile to a smaller dimension half hexagon profile groove.
Figure 73:
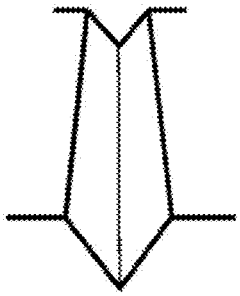
FIG. 73 shows an exemplary large V to a smaller V profile groove.
Figure 74:
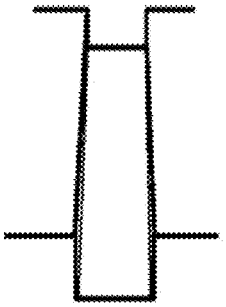
FIG. 74 shows an exemplary large box to a small box profile groove.
Figure 75:
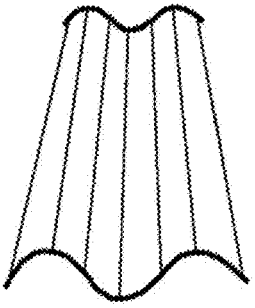
FIG. 75 shows an exemplary large sinusoidal to a small sinusoidal profile groove.
Figure 76:
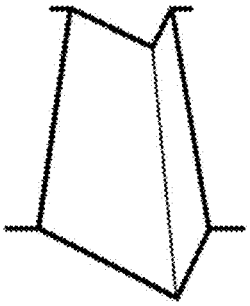
FIG. 76 shows an exemplary large off-center to a small off-center profile groove.
Figure 77:
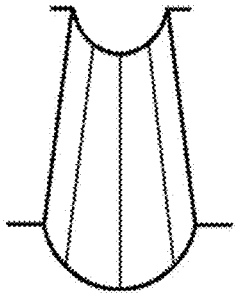
FIG. 77 shows an exemplary large dome to a small dip profile groove.

FIGS. 72, 73, 74, 75, 76 and 77 display front perspective views of alternative profile shapes for the exemplary grooves. Particularly, these profile shapes of the grooves change their size along the length of the groove. FIG. 72 shows a groove profile shape transition along its length from a half hexagon profile to a smaller dimension half hexagon profile. FIG. 73 shows a groove profile shape transition along its length from a large V profile to a smaller dimensioned V profile. FIG. 74 shows a groove profile shape transition along its length from a large box to a smaller box profile. FIG. 75 shows a groove profile shape transition along its length from a large sinusoidal to a small sinusoidal profile. FIG. 76 shows a groove profile shape transition along its length from a large off-center profile to a smaller off-center profile. FIG. 77 shows a groove profile shape transition along its length from a large dip profile to a smaller dip profile.

Figure 78:
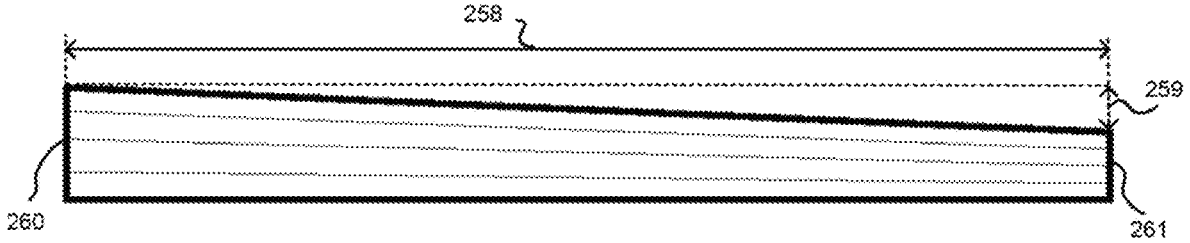
FIG. 78 shows a cross-sectional view of an exemplary groove embodiment with varying height.

FIG. 78 shows a cross-sectional view of the groove embodiment shown in FIG. 75, which can be modified according to the other-described FIGS. In this figure it can be seen that the lateral apex 258 of the diminishing irregular groove to slant down from back edge 260 to the front edge 261. The lateral apex reduces height by a dimension 259. A benefit of diminishing irregular grooves, perpendicular or non-perpendicular to the longitudinal front axes of the gutter to the back roofline (when the device is in use), is it enables debris to more readily slide off the device.

Figure 79:
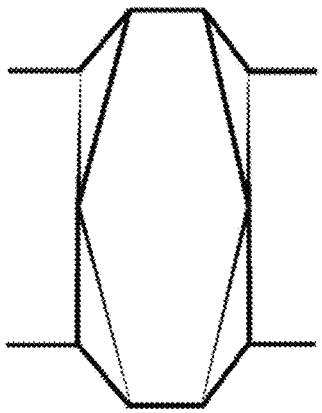
FIG. 79 shows a groove profile shape transition along its length from a half hexagon profile to nothing and then back to a half hexagon profile.
Figure 80:
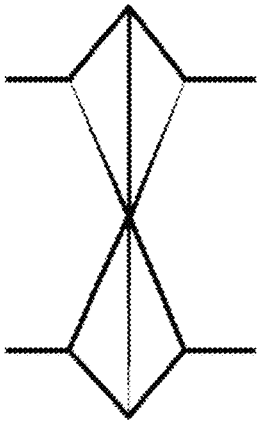
FIG. 80 shows a groove profile shape transition along its length from a V profile to virtually nothing and back to a V profile.
Figure 81:
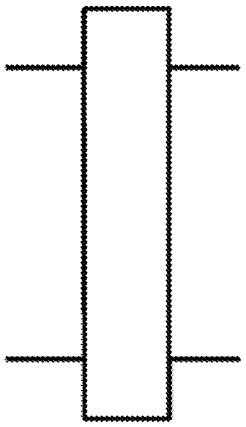
FIG. 81 shows an exemplary box shaped groove.
Figure 82:
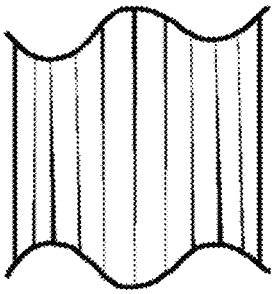
FIG. 82 shows a groove profile shape transition along its length from a sinusoidal to virtually nothing and back to sinusoidal.
Figure 83:
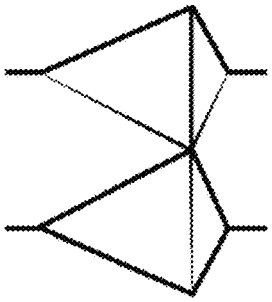
FIG. 83 shows a groove profile shape transition along its length from an off-center profile to virtually nothing and back to an off-center profile.
Figure 84:
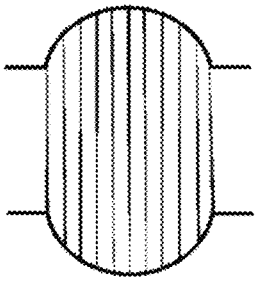
FIG. 84 shows a groove profile shape transition along its length from a recessed dip profile to virtually nothing and back to a recessed dip profile.

FIGS. 79, 80, 81, 82, 83 and 84 display views of alternate shapes for the exemplary grooves. Most of the shapes of the grooves are considered as irregular or geometric, some having a changing profile along the length of the groove. FIG. 79 shows a groove profile shape transition along its length from a half hexagon profile to nothing (planar profile shape) and then back to a half hexagon profile. FIG. 80 shows a groove profile shape transition along its length from a V profile to nothing and back to a V profile. FIG. 81 shows a box shape along the entire length of the groove. FIG. 82 shows a groove profile shape transition along its length from a sinusoidal to nothing and back to sinusoidal. FIG. 83 shows a groove profile shape transition along its length from an off-center profile to nothing and back to an off-center profile. FIG. 84 shows a groove profile shape transition along its length from a bumped dip profile to nothing and to a recessed dip profile. It should be noted that while the above Figs. illustrate a "symmetry" in the transitions of the groove shapes or geometry, non-symmetric configurations may be implemented.

Figure 85:
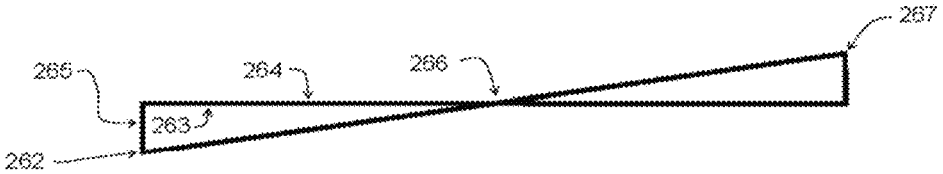
FIG. 85 shows an exemplary symmetric and reversed half hexagon shaped groove.

FIG. 85 is a cross-sectional sideview of a half hexagon shaped groove, wherein the irregular groove 262 starts under a side 263 of planar surface 264 of the decking on a front side 265, then travels to an intersecting point 266 which is half way between both ends of the groove, where the irregular groove diminishes into a planar form. The groove length, then extends from the intersecting point 266 to a rear side 267, wherein is forms the shape of a half hexagon again and wherein the shape is now reversed 180 degrees from its original perspective. At the intersecting point 266, the shape of the groove is planar.

Figure 86:
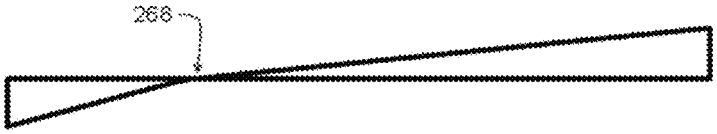
FIG. 86 shows an exemplary non-symmetric and reversed half hexagon shaped groove.
Figure 87:
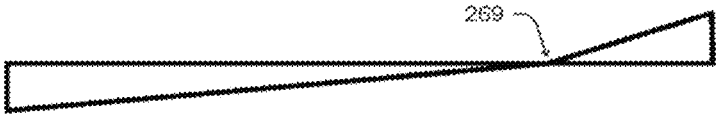
FIG. 87 shows another exemplary non-symmetric and reversed half hexagon shaped groove.
Figure 88:
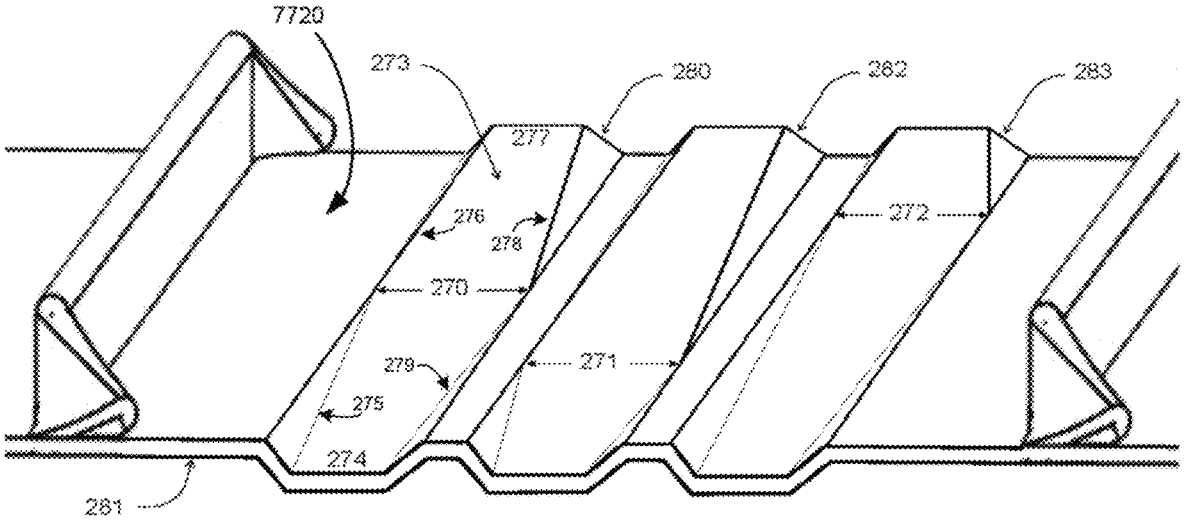
FIG. 88 shows an alternative embodiment of an exemplary bridge portion with transitioning grooves.

It will be appreciated that the intersecting point can be disposed at different positions along the X-axis (see for example, FIG. 88). The X-axis being an axis between the front and back of the bridge portion. FIG. 86 for example, shows the intersecting point farther left 268 of the middle along the X-axis or more toward the front from the middle. FIG. 87 shows another example wherein the intersecting point 269 is farther toward the back from the middle. Varying the intersecting points from one irregular groove to another adjacent groove provides additional integrity of the micromesh decking.

FIG. 88 shows a partial bottom perspective view of an alternative embodiment of an exemplary bridge portion 7720. As previously stated, for clarity, the orifices in the decking of the bridge portion 7720 are not shown. This bridge portion 7720 includes three half hexagon irregular grooves 280, 282 and 283 with different intersecting points 270, 271 and 272, respectively. These three grooves correspond with the grooves shown in FIGS. 85, 86 and 87, respectively. The groove 280 in the decking plane 273 includes a six-sided 274, 375, 276, 277, 278 and 279 irregular polygon shaped base. This base of the irregular groove 280 is slanted laterally towards the front 281, which when in use would be toward the gutter lip. This configuration further helps in allowing leaves and pine needles to slide off the gutter and onto the ground. All three irregular grooves 280, 282 and 283 show grooves starting out along their respective lengths with the half hexagon shape and end with the half hexagon shape. It will be appreciated that although the starting and ending of the irregular grooves are the shape of the half hexagon, they can by design transition into any other shape at the other end of their respective lengths, such as a triangle, box, sinusoidal, off center, dip or other shape, such as but not limited to the shapes shown in FIGS. 67-71. Further, in FIG. 88, all three irregular grooves 280, 282 and 283 show grooves, each starting out along their lengths with the half hexagon shape and ending with the same sized half hexagon shape at the respective opposing end. It will however be appreciated that the grooves can transition in smaller sizes, such as but not limited to the examples shown in FIGS. 72-77.

FIG. 89 displays a bottom, front perspective view of a portion of an alternative embodiment of an exemplary bridge portion. For purposes of clarity the orifices in the decking 287 of the bridge portion and the at least one truss are not shown. In this embodiment, the at least one groove is three grooves 284, 285 and 286. These grooves are irregular in their respective shapes. The grooves are formed above, below and above the decking 287, respectively. Each of the grooves 284, 285 and 286 has a planar apex surface 289, 288, and 290, respectively. The spacing between these irregular grooves can be varied in other embodiments. For illustration, these grooves can be bifurcated, as shown with groove 285. Groove 285 has a bottom chord 291, which bifurcates to two secondary chords 292 and 293.

Figure 95:
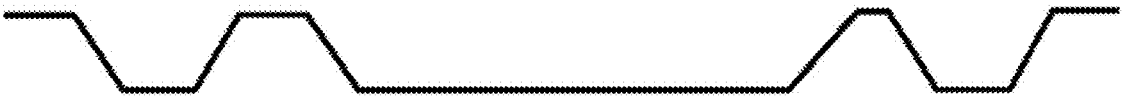
FIG. 95 illustrates an exemplary bridge portion having irregular grooves with varying groove widths.
Figure 96:
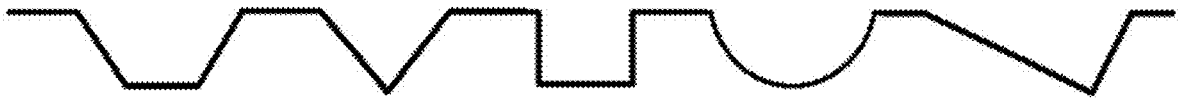
FIG. 96 illustrates an exemplary bridge portion having irregular grooves with varying groove shapes.
Figure 97:
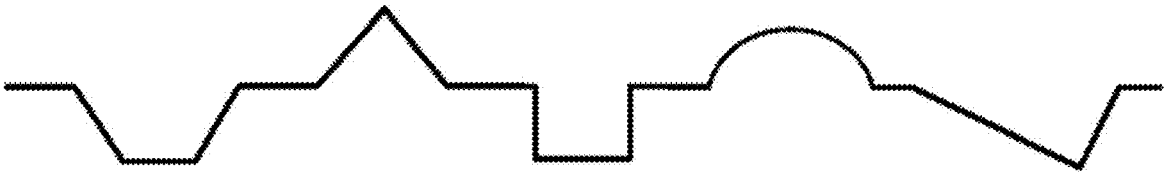
FIG. 97 illustrates an exemplary bridge portion having irregular grooves with cross plane varying groove shapes.
Figure 98:
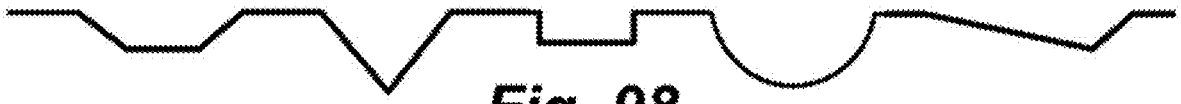
FIG. 98 illustrates an exemplary bridge portion having irregular grooves with varying groove shape and groove heights.
Figure 99:
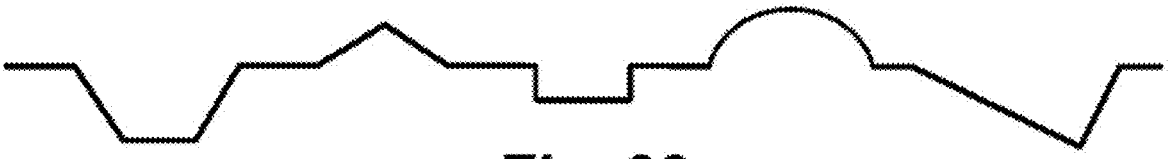
FIG. 99 illustrates an exemplary bridge portion having irregular grooves with cross plane varying groove shapes and groove heights.

FIGS. 90, 91, 92, 93, 94, 95, 96, 97, 98 and 99 display of partial front profile views of various examples of groove arrangement for alternate embodiment of an exemplary bridge portion. Note, for purposes of clarity girders are not shown. FIG. 90 illustrates a bridge portion having a plurality alternating irregular grooves. FIG. 91 illustrates a bridge portion having a plurality downward irregular grooves. FIG. 92 illustrates a bridge portion having a plurality upward irregular grooves. FIG. 93 illustrates a bridge portion having a plurality of cross plane irregular grooves. FIG. 94 illustrates a bridge portion having a plurality of irregular grooves with varying groove heights. FIG. 95 illustrates a bridge portion having irregular grooves with varying groove widths. FIG. 96 illustrates a bridge portion having irregular grooves with varying groove shapes. FIG. 97 illustrates a bridge portion having irregular grooves with cross plane varying groove shapes. FIG. 98 illustrates a bridge portion having irregular grooves with varying groove shape and groove heights. FIG. 99 illustrates a bridge portion having irregular grooves with cross plane varying groove shapes and groove heights.

Figures 100, 101:
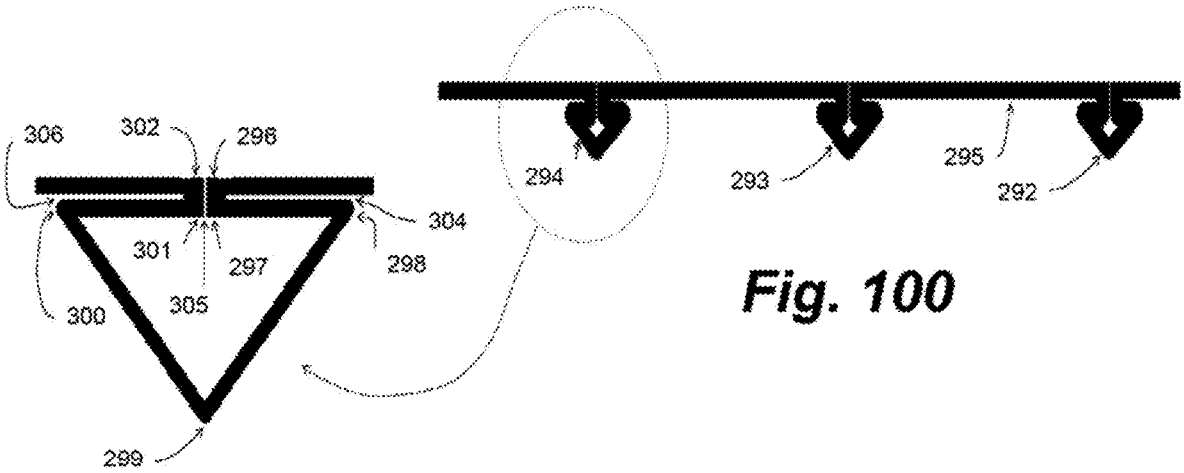
FIG. 100 shows a partial rear profile view of an alternative embodiment of a bridge portion with various shaped girder.
FIG. 101 is a closeup view of the girder shown in FIG. 100.

FIG. 100 shows a partial rear profile view of an alternative embodiment of a bridge portion with various shaped girders, 292, 293 and 294 on the decking 295. Note, for purposes of clarity, the orifices in the bridge portion are not shown. Theses girders 292, 293 and 294 have the shape of a hollow triangle. FIG. 101 is a closer view of the girder 294, wherein it can be seen that the girders can be made by forming bends in the decking 295. Particularly, the girder 294 includes bends or corners 296, 297, 298, 299, 300, 301, and 302. This hollow triangular shape greatly enhances the overall strength of the girder 294 and thus the overall strength of the device for supporting loads on the bridge portion. When formed, the triangle may be pressed against the decking 295 with little to no gap between them. If gaps are formed from the manufacturing, they will be the areas 304, 305 and 306. FIGS. 100 and 101 illustrate that the exemplary girders do not have to be "planar" in form, but can polygon in shape or even circular (oval, etc.)

It will be appreciated that girders of the present invention increase load capacity of the devices as the height of the girder increases. Girders of the present invention also allow for greater distance from each other on the device. Thus, fewer girders on the device are needed, which in turn provides a greater flat area on the bridge portion of the device. Fewer girders means less material to manufacture, thus saving manufacturing costs.

It will be appreciated that the decking material of the bridge portions of all the above illustrated embodiments include orifices which were not shown in the figures for purposes of clarity.

While this invention has been described in conjunction with the specific embodiments outlined above, it is evident that many alternatives, modifications and variations will be apparent to those skilled in the art. Accordingly, the described embodiments of the invention, as set forth above, are intended to be illustrative, not limiting. Thus, various changes and combinations thereof may be made without departing from the spirit and scope of this invention. When structures are identified as a means to perform a function, the identification is intended to include all structures, which can perform the function specified.

What is claimed is:

1. A gutter guard comprising:

a mesh decking having a plurality of orifices, a gutter lip side and a roof side;

a plurality of main folds of the mesh decking extending from the gutter lip side to the roof side, forming a plurality of unitary girders under the mesh decking;

secondary folds on opposing ends of the plurality of main folds;

a roof attachment rail, coupled to a flattened gutter lip side end; and a gutter lip attachment rail, coupled to a flattened roof side end, wherein the gutter guard is self-supporting due to the plurality of unitary girders.

2. The gutter guard of claim 1, wherein the decking is at least one of pre-tensioned woven strands of material and inter-woven diagonal strands of material.

3. The gutter guard of claim 1, wherein girders of the plurality of unitary girders are equidistant from each other.

4. The gutter guard of claim 1, wherein a girder of the plurality of unitary girders spans the decking in a non-orthogonal orientation.

5. The gutter guard of claim 1, wherein at least one of the roof attachment rail and the gutter lip attachment rail have a receiving center configured for securing the mesh decking to the respective attachment member.

6. A gutter guard comprising:

a mesh decking having a plurality of orifices, a gutter lip side and a roof side;

a plurality of main folds of the mesh decking extending from the gutter lip side to the roof side, forming a plurality of girders protruding under the mesh decking; and a plurality of height-reducing bends at the gutter lip side end and roof side end of the plurality of main folds, reducing a terminal end height of the main folds;

wherein the gutter guard is self-supporting due to the plurality of girders.

7. The gutter guard of claim 6, wherein the mesh decking is at least one of pre-tensioned woven strands of material and inter-woven diagonal strands of material.

8. The gutter guard of claim 6, further comprising:

a roof attachment member, coupled to the gutter lip side end; and a gutter lip attachment member, coupled to the roof side end.

9. The gutter guard of claim 6, wherein girders of the plurality of girders are equidistant from each other.

10. The gutter guard of claim 6, wherein a girder of the plurality of girders spans the mesh decking in a non-orthogonal orientation.

11. The gutter guard of claim 6, wherein at least one of the roof attachment member and the gutter lip attachment member have a receiving center configured for securing the mesh decking to the respective attachment member.

* * * * *